US011246428B2

(12) United States Patent
Padvoiskis et al.

(10) Patent No.: US 11,246,428 B2
(45) Date of Patent: Feb. 15, 2022

(54) PRODUCT DISPLAY MERCHANDISER AND RELATED METHODS

(71) Applicant: Retail Space Solutions LLC, Milwaukee, WI (US)

(72) Inventors: Julia Padvoiskis, Milwaukee, WI (US); Michael William Mercier, Chicago, IL (US); Matthew A. Wills, Grafton, WI (US); Eric Pollpeter, Cedarburg, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 123 days.

(21) Appl. No.: 16/511,717

(22) Filed: Jul. 15, 2019

(65) Prior Publication Data

US 2020/0015601 A1 Jan. 16, 2020

Related U.S. Application Data

(60) Provisional application No. 62/767,269, filed on Nov. 14, 2018, provisional application No. 62/698,746, filed on Jul. 16, 2018.

(51) Int. Cl.

| | |
|---|---|
| ***A47F 1/12*** | (2006.01) |
| ***A47F 5/08*** | (2006.01) |
| ***A47F 5/00*** | (2006.01) |

(52) U.S. Cl.

CPC ..... *A47F 1/126* (2013.01); *A47F 5/005* (2013.01); *A47F 5/08* (2013.01)

(58) Field of Classification Search

CPC .. A47F 1/126; A47F 5/08; A47F 5/005; A47F 1/12; A47F 1/04; A47F 7/28; A47F 5/0087; A47F 1/125; A47F 5/0025; A47F 3/14; A47F 7/0007; A47F 3/02; A47F 7/281; A47F 5/0043

USPC ..... 211/59.2, 59.3, 59.4, 184, 74, 49.1; 312/71, 45, 42

See application file for complete search history.

(56) References Cited

U.S. PATENT DOCUMENTS

| | | | | |
|---|---|---|---|---|
| 5,855,283 | A | 1/1999 | Johnson | |
| 5,878,895 | A * | 3/1999 | Springs | A47F 1/126 211/59.3 |
| 5,992,652 | A * | 11/1999 | Springs | A47F 1/126 211/59.3 |
| 6,533,131 | B2 | 3/2003 | Bada | |
| 6,886,699 | B2 | 5/2005 | Johnson et al. | |
| 7,028,852 | B2 | 4/2006 | Johnson et al. | |
| 7,124,898 | B2 | 10/2006 | Richter et al. | |
| 7,195,123 | B2 | 3/2007 | Roslof et al. | |
| 7,681,744 | B2 | 3/2010 | Johnson | |
| 7,681,745 | B2 | 3/2010 | Richter | |
| 7,854,333 | B2 | 12/2010 | Kottke et al. | |

(Continued)

FOREIGN PATENT DOCUMENTS

WO 2018200997 A1 11/2018

*Primary Examiner* — Hiwot E Tefera

(74) *Attorney, Agent, or Firm* — Andrus Intellectual Property Law, LLP

(57) ABSTRACT

A product display merchandiser includes a product support, a pair of sidewalls extending upwardly from respective sides of the product support, a first product stop extending upwardly from a front end of the product support, and a second product stop extending from at least one of the pair of sidewalls.

17 Claims, 21 Drawing Sheets

(56) References Cited

U.S. PATENT DOCUMENTS

| | | | | |
|---|---|---|---|---|
| 8,038,018 | B1 * | 10/2011 | Breitenbach | G07F 11/42 211/59.3 |
| 9,433,305 | B2 * | 9/2016 | Bird | A47F 7/285 |
| D801,734 | S | 11/2017 | Turner et al. | |
| 9,877,599 | B2 | 1/2018 | Turner et al. | |
| D812,945 | S | 3/2018 | Turner et al. | |
| 10,154,739 | B2 | 12/2018 | Turner et al. | |
| D836,954 | S | 1/2019 | Turner et al. | |
| D843,760 | S | 3/2019 | Turner et al. | |
| 10,314,412 | B2 | 6/2019 | Turner et al. | |
| 10,334,967 | B2 | 7/2019 | Mercier et al. | |
| 2004/0020877 | A1 * | 2/2004 | Boron | A47F 1/12 211/59.2 |
| 2004/0118793 | A1 * | 6/2004 | Burke | A47F 1/126 211/59.3 |
| 2006/0196840 | A1 * | 9/2006 | Jay | A47F 1/12 211/59.2 |
| 2007/0175845 | A1 * | 8/2007 | Hardy | A47F 1/126 211/184 |
| 2008/0011696 | A1 * | 1/2008 | Richter | A47F 1/126 211/59.2 |
| 2008/0129161 | A1 * | 6/2008 | Menz | A47F 1/12 312/120 |
| 2012/0103922 | A1 * | 5/2012 | Bird | A47F 1/126 211/59.3 |
| 2014/0034590 | A1 * | 2/2014 | Szpak | A47F 1/04 211/59.2 |
| 2017/0196355 | A1 * | 7/2017 | Hardy | A47F 5/005 |
| 2017/0202369 | A1 | 7/2017 | Mercier et al. | |
| 2017/0251835 | A1 | 9/2017 | Fluegge et al. | |
| 2018/0035825 | A1 | 2/2018 | Pollpeter et al. | |
| 2018/0103775 | A1 | 4/2018 | Kaczmarek et al. | |
| 2018/0153313 | A1 | 6/2018 | Padvoiskis et al. | |
| 2018/0199733 | A1 | 7/2018 | Mercier et al. | |
| 2018/0360233 | A1 | 12/2018 | Turner et al. | |
| 2020/0022507 | A1 * | 1/2020 | De Sanctis | B65G 1/04 |

* cited by examiner

PRODUCT DISPLAY MERCHANDISER AND RELATED METHODS

CROSS-REFERENCE TO RELATED APPLICATIONS

The present application claims the benefit of U.S. Provisional Application No. 62/698,746, filed Jul. 16, 2018, and U.S. Provisional Application No. 62/767,269, filed Nov. 14, 2018, both of which applications are hereby incorporated herein by reference in their entireties.

FIELD

The present disclosure relates generally to product displays and, more particularly, to merchandisers for front-facing product merchandise for displaying and dispensing product to consumers, as well as methods relating to same.

BACKGROUND

U.S. Pat. No. 7,681,744 discloses a merchandising system for articles comprising a base comprising an upper surface having a plurality of ribs, an underside having a plurality of supports formed integrally with the underside of the base, and a first side and a second side. The merchandising system comprises a frame coupled to the base and configured to couple with a shelving system for supporting the base in a substantially horizontal configuration, a first guide and a second guide coupled to the base for supporting articles, and an assembly for advancing the articles that is coupled to the base and provides force on the articles.

U.S. Patent Application Publication No. 2018/0153313 discloses a shelf management system having a tray defining a first mating structure and a second mating structure, a shelf management component having a spring biased pusher connected thereto and movable between a first position wherein the pusher is extended to a rear of the shelf management component and a second position wherein the pusher is retracted to a front of the shelf management component, and an interstitial member positioned between the shelf management component and the tray to secure the shelf management component to the tray and hinder lateral movement of the shelf management component with respect to the tray. Improved components of the shelf management system are also disclosed as are methods relating to same.

U.S. Patent Application Publication No. 2018/0360233 discloses a product display tray including one or more arms including engagement members. The product display tray can also include a base having one or more tracks receiving the one or more arms, wherein the base is slidable along the one or more arms from a first position to a second position. The product display tray can also include a handle. The product display tray can also include a latch, wherein the latch is operably connected to the handle, wherein the latch has an engaged position and a disengaged position, and wherein the latch is in the engaged position when the base is in the first position and the base is operable to enter the second position when the latch is in the disengaged position.

U.S. Pat. No. 10,334,967 discloses a product display merchandiser comprising a support member, an intermediate member movably attached to the support member, and a product support attached to the intermediate member. The intermediate member being movable between at least a retracted position and an extended position.

The above-noted patents and publications are hereby incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a product display merchandiser comprises a product support and a pair of sidewalls extending upwardly on respective longitudinally extending sides of the product support. A first product stop extends upwardly from a front end of the product support and is configured to contact a bottom end of a front-most product with which the product display merchandiser is to be stocked. A second product stop is coupled to at least one sidewall of the pair of sidewalls and is configured to contact at least one of a top end and a side edge of the front-most product. A pusher is longitudinally slidable relative to the product support and biased toward the front end of the product support.

According to another example of the present disclosure, a product display merchandiser comprises a tray having a product-supporting top surface, a pair of sidewalls extending upwardly with respect to the top surface of the tray and along respective opposite, longitudinally extending sides of the tray, and a pusher longitudinally slidable along the top surface of the tray and positioned between the sidewalls of the pair of sidewalls. The product display merchandiser comprises first and second product stops, each product stop being coupled to at least one of the tray and a sidewall in the pair of sidewalls, and each product stop having a product-contacting surface configured to contact a front face of a front-most product with which the product display merchandiser is to be stocked to inhibit removal of the front-most product from the product display merchandiser. At least one of the first and second product stops is movable such that its product-contacting surface moves between a first orientation in which its product-contacting surface is configured to contact the front face of the front-most product and a second orientation that allows the front-most product to be pulled past its product-contacting surface in a forward-directed motion and thus to be removed from the product display merchandiser.

BRIEF DESCRIPTION OF THE DRAWINGS

Examples of product display merchandisers are described with reference to the following Figures. The same numbers are used throughout the Figures to reference like features and like components. Reference numbers used herein are formatted such that the first digit refers to the embodiment and the last two digits refer to the component. Therefore, unless explicitly stated otherwise, it is assumed that components sharing the same final two digits share the same description as in previous embodiments. For example, a component labeled 622 operates in substantially the same manner as the component labeled 122.

DETAILED DESCRIPTION

Many variations of product displays are discussed herein and even further are contemplated in view of this disclosure. The product displays discussed herein are configured and designed to hold and display product that is for sale and to front face this product so that the next item in the display is moved to the front of the display as the product in front of it is removed from the merchandiser.

Product displays, such as merchandisers, are frequently used in retail environments to display products for sale. It is advantageous for these product displays to be configured to provide consumers easy access to the displayed product as well as facilitate easy reloading by store employees. In addition to ease of use considerations, manufacturers of product displays seek to minimize materials and manufacturing costs associated with the product displays.

One problem with conventional merchandisers arises when used with products packaged in cling wrap, such as fresh produce. The cling wrap can cause adjacent products to stick to one another so that when the first product is pulled out, it pulls out the next product in line as well. The cling wrap can also stick to the merchandiser itself causing it to jam, or stick to the front lens making the products difficult to remove by the customer. When a cling wrapped package is pulled along a surface of a second cling wrapped package, such as when the front package in an existing front-facing merchandiser is lifted up to clear the front lens, the friction between the two packages can cause the wrap to tear.

Accordingly, it has been determined that a need exists for improved product display merchandisers that are configured to display and dispense products packaged in cling wrap or other material that sticks to itself.

Figure 1:
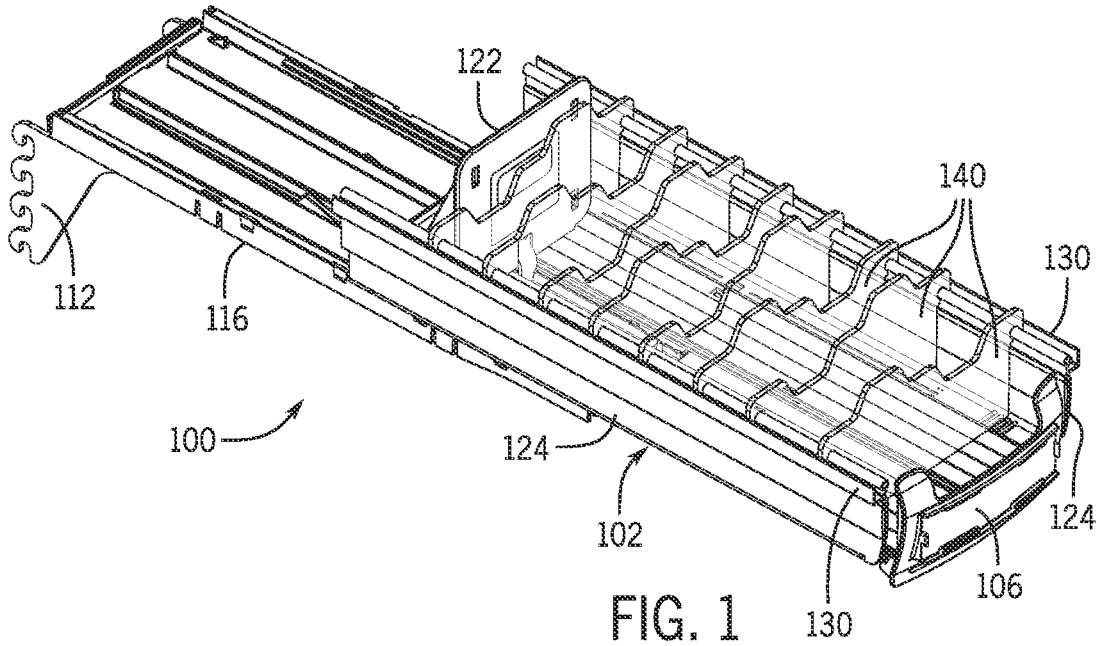
FIG. 1 is a perspective view of a product display merchandiser according to some embodiments of the present disclosure taken from above and in front of the merchandiser (or the upper left front) and illustrating an exemplary partitioned design in a first, extended position.
Figure 2:
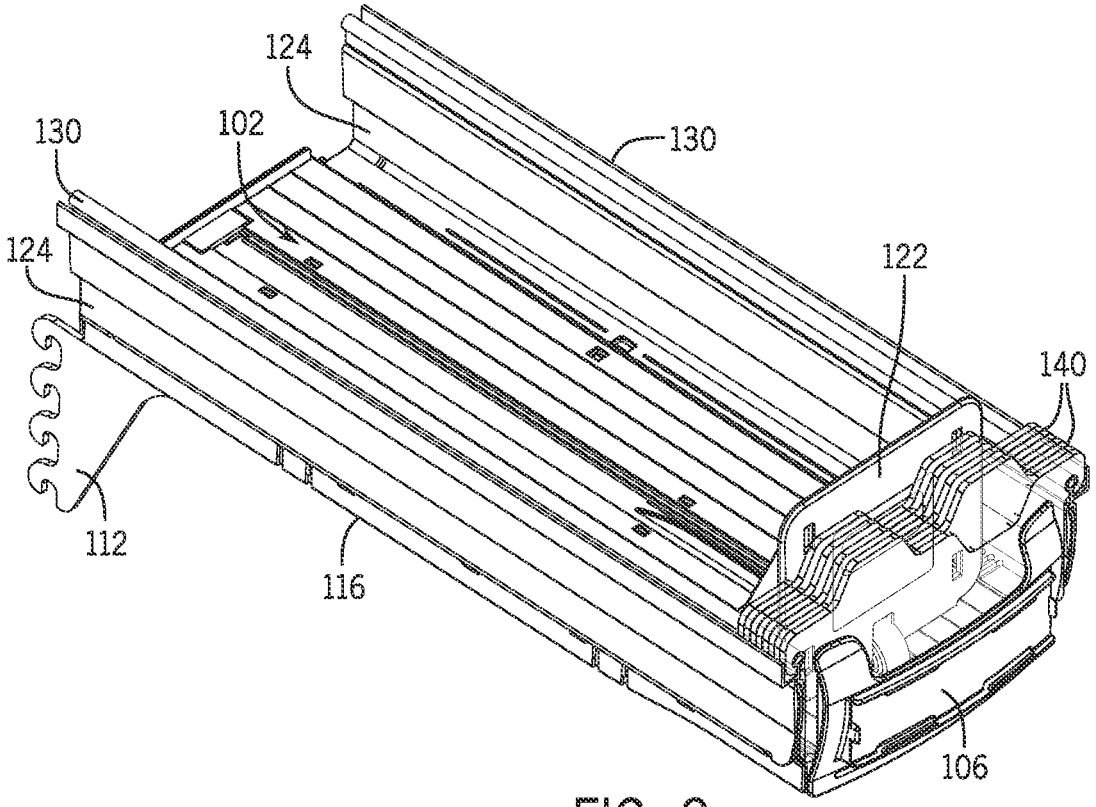
FIG. 2 is an alternate perspective view of the product display merchandiser of FIG. 1, and illustrating the merchandiser in a second, retracted position.
Figure 6:
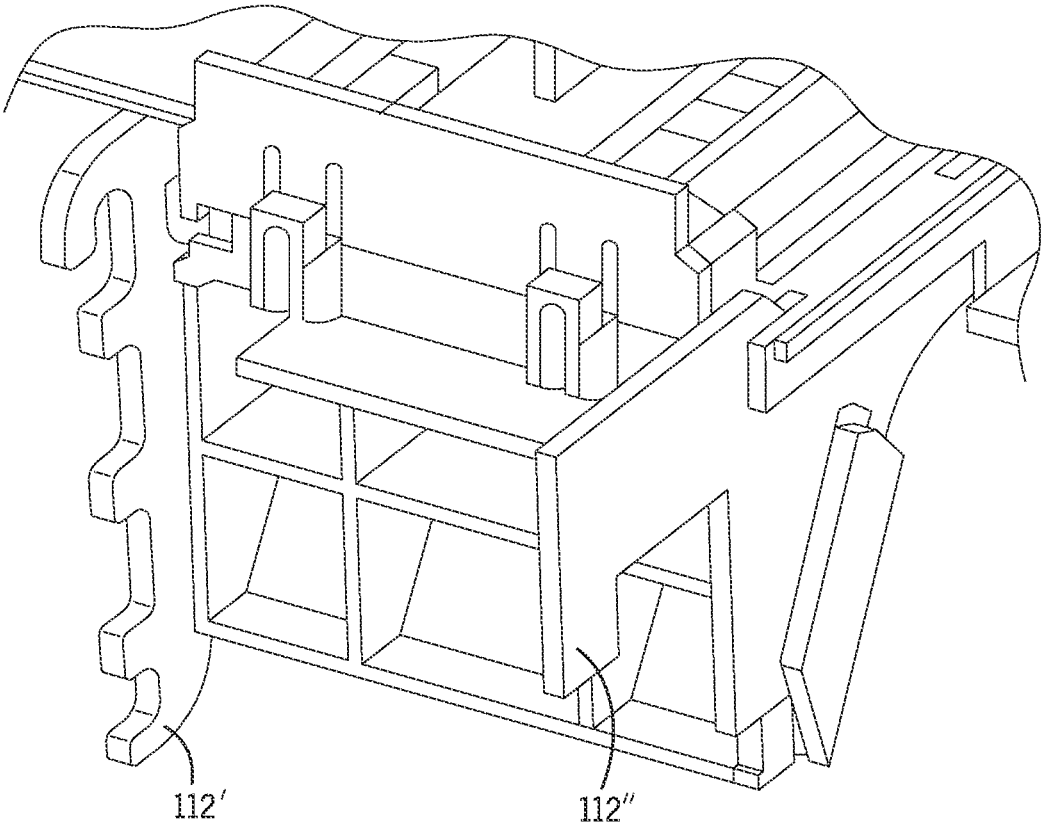
FIG. 6 is a perspective view of alternative engagement members for use in the merchandiser of FIGS. 1 and 2.

FIGS. 1 and 2 show a front-facing merchandiser or product display merchandiser 100 according to a first embodiment of the present disclosure. The product display merchandiser 100 comprises a tray 102 supported by a base 116. The tray 102 comprises a product support surface. The base 116 can be a solid base as shown, or the base 116 can be replaced by one or more arms (such as two parallel support bars) in a baseless design. In such a configuration, the product display merchandiser 100 may further include a rear stabilizer connecting the rear of the support arms to stabilize same as disclosed in U.S. Patent Application Publication No. 2018/0360233. The base 116 includes one or more engagement member 112 to attach the product display merchandiser 100 to a shelving unit. In the present embodiment, the engagement member 112 is configured to attach to a series of horizontal members that are part of a grid. Alternative engagement members 112', 112" for engaging with different types of supports are shown in FIG. 6. Engagement member 112' is also configured to mount on a grid, while engagement member 112" is configured to mount on a bar. In operation, a product display merchandiser 100 would only have one type of engagement member 112, 112', or 112"; FIG. 6 merely shows two types of engagement members 112', 112" to illustrate the different choices. In still further embodiments, the engagement members 112 can be configured to attach the product display merchandiser 100 to a shelf. Example systems to slidably mount a merchandiser tray to a base that rests on a shelf can be seen in U.S. Patent Application Publication No. 2018/0153313. In some embodiments, the tray 102 is rotatably attached to the base 116. Example systems to rotatably attach a tray 102 to a base 116 can be seen in U.S. Pat. No. 10,334,967.

The tray 102 comprises a channel formed by two wings or sidewalls 124. The front of the channel has a front lens 106. The front lens 106 serves as a stop to prevent a pusher 122 from pushing products off of the tray 102. In some embodiments the front lens 106 also includes one or more price channels configured to hold price stickers and/or product indicia. The pusher 122 is biased towards the front lens 106 and serves to push products placed within the channel towards the front of the product display merchandiser 100; such biasing can be achieved, for example, by a coil spring. The coil spring can be a constant force spring or a variable force spring, as known to those having ordinary skill in the art. A partition rail 130 or guide is attached to each of the sidewalls 124. A plurality of partitions 140 are movable along the partition rails 130. In alternative embodiments, the partition rails 130 are integrated into the sidewalls 124 instead of being separate, removable pieces.

The partitions 140 are slidable along the length of the tray 102. Each partition 140 is slidable from at least one first position closer to the rear of the tray 102 and at least one second position closer to the front of the tray 102. As shown in FIG. 1, the partitions 140 can be spaced along the length of the tray 102 so as to receive a plurality of products separated from each other by individual partitions 140. FIG. 2 shows the partitions 140 in an arrangement in which they are all pushed up against the front lens 106. Because the partitions 140 are slidable, they are pushed towards the front lens 106 by the pusher 122.

The tray 102 is slidable relative to the base 116, such that the tray 102 is a pull-out tray wherein the product support channel portion of the tray 102 is movable between a retracted position for normal dispensing of product and an extended position in which the product support channel portion of the tray 102 is extended from the base 116 to allow for easier stocking or restocking of the tray 102. The retracted position of the tray 102 shown in FIG. 2 is a display position. Pulling the tray 102 out into the extended position shown in FIG. 1 allows for easier loading. In alternative embodiments, the tray 102 is fixed relative to the base 116. In still further alternative embodiments, the tray 102 includes the engagement members 112, and there is no base 116.

Figure 3:
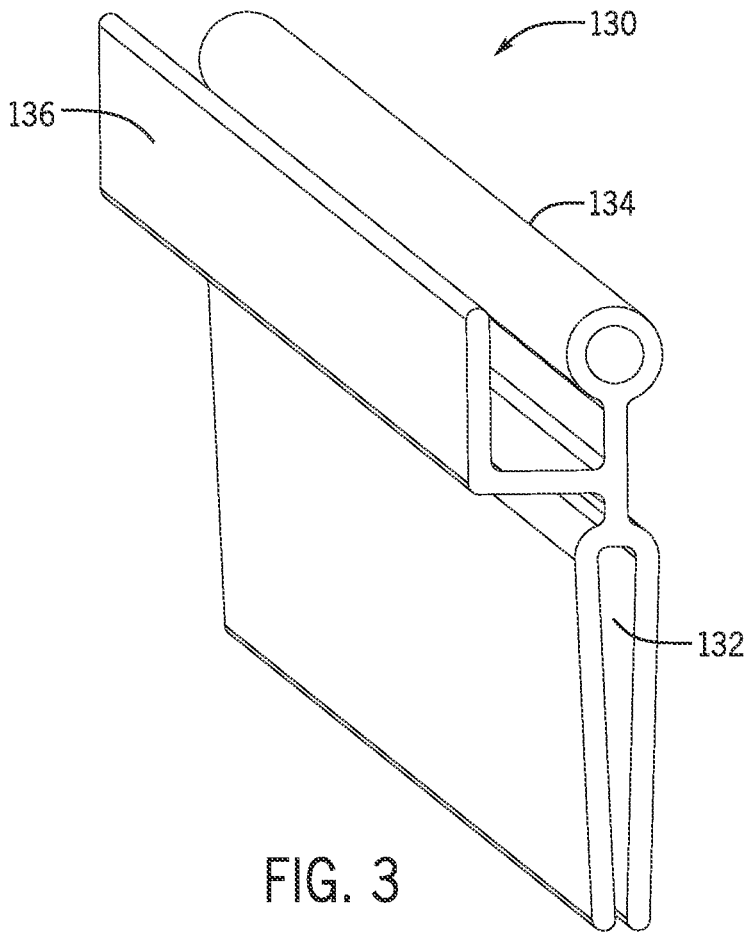
FIG. 3 is a perspective view of a partition rail of FIGS. 1 and 2.

FIG. 3 is a perspective view of a partition rail 130. The partition rail 130 has a recess 132 configured to fit over the top edge of the sidewall 124 of the product display merchandiser 100. In alternative embodiments, the partition rail 130 has one or more projections configured to fit into one or more grooves in the sidewall 124. In a still further alternative embodiment, the recess 132 is defined by a series of fingers on alternating sides of the recess in order to save material. The partition rail 130 can further include features for preventing the partition rail 130 from sliding longitudinally relative to the sidewall 124. This can be achieved by a recess in the partition rail 130 configured to receive a projection in the sidewall 124, or by a projection on the partition rail 130 configured to be received in a recess in the sidewall 124, or in many other ways.

The partition rail 130 includes an attachment member 134. The attachment member 134 is configured to receive one side of each partitions 140. In the present embodiment, the attachment member 134 has a substantially cylindrical shape which fits inside substantially circular holes in the partitions 140. In alternative embodiments, the attachment member 134 comprises a channel configured to receive a projection of the partition 140.

A projection 136 separates the partition rail 130 from adjacent product display merchandisers 100. The projection 136 is configured such that it is positioned laterally outside of the widest point of the partitions 140 when the partitions 140 are installed on the partition rail 130 so as to prevent the partitions 140 from contacting any structure adjacent to the product display merchandiser 100 and becoming jammed or bound.

The partition rail 130 is made through either extrusion or injection molding. In a preferred embodiment, the partition rail 130 is extruded. In a preferred embodiment, the partition rail 130 is made of a low friction material that will enable the partitions 140 and the cling wrapped products to freely slide along the partition rail 130 without sticking. Possible materials include but are not limited to acetyl plastic, ABS, other plastics, or a silicon impregnated polymer.

In preferred embodiments, the partition rail 130 is symmetrical along the vertical axis thereof, such that the left partition rail 130 is identical to the right partition rail 13, but installed in an opposite direction on the respective sidewall 124. This prevents the necessity of keeping the partition rails 130 stored in matching pairs when not in use, and saves money by only requiring a single type of replacement partition rail 130 and a single machine or line for producing partition rails 130.

In some embodiments, the partition rail 130 is configured to apply an increasing amount of resistance as the pusher 122 approaches the front lens 106 so as to dampen pushing. This prevents the product or the pusher 122 from being damaged if the pusher 122 is pushed back and then allowed to accelerate forward into the products. The dampening effect can be achieved by angling the partition rails 130 inward toward each other as they approach the front lens 106 so that they contact the pusher 122 or the rearmost partition 140 as it moves forward.

Figure 4:
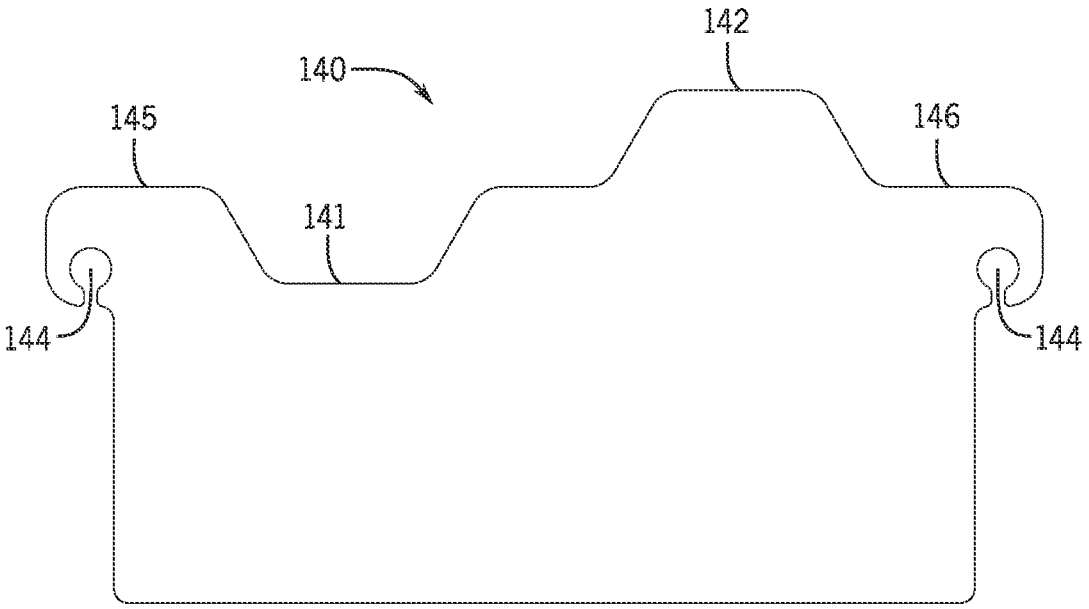
FIG. 4 is a front elevation view of a partition of FIGS. 1 and 2.

FIG. 4 is a front elevation view of a partition 140 according to a first embodiment of the present invention. The partition 140 comprises attachment members 144 configured to engage the attachment members 134 of the partition rails 130. The attachment members 144 are positioned in partition wings 145/146 extending outward from its main body. The attachment members 144 in the present embodiment are substantially circular holes configured to ride along the cylindrical attachment members 134 of the partition rails 130. The holes are slotted in order to aid in construction through either injection molding or extrusion.

In a preferred embodiment, the partition 140 is made of a low friction material that will enable it to freely slide along the partition rail 130 without sticking. The low friction material will also allow cling wrapped products to easily be removed from the product display merchandiser 100 without sticking to the partitions 140. Possible materials include but are not limited to acetyl plastic, ABS, other plastics, or a silicon impregnated polymer. The partitions 140 can be opaque or translucent. In a preferred embodiment the partitions 140 are transparent so that the products can be seen through the partitions 140 at the front of the tray 102.

The attachment member 144 is configured to fit loosely about the attachment member 134 of the partition rail 130. This is to reduce instances of binding or racking when a partition 140 becomes angled or twisted. Racking can also be reduced by using a wide pusher 122 centered at the center of the partitions 140 as shown in FIGS. 1 and 2. In a preferred embodiment, the pusher 122 covers 80% of the surface area of the rearmost partition 140 so as to keep the partitions 140 square to the sidewalls 124. A strong biasing force by the pusher 122 also prevents racking by overcoming the resistance when the partitions 140 do become twisted.

In the embodiment shown in FIG. 4, the partitions 140 are attached to the partition rails 130 by sliding them on from one end of the partition rail 130. This can be done before the partition rails 130 are attached to the sidewalls 124 in embodiments where the partition rails 130 are not integrated into the tray 102. In alternative embodiments, the front lens 106 or pusher 122 can be removed, moved, or flexed to a point beyond the ends of the partition rails 130 so that the partitions 140 can be installed/added when the partition rails 130 are attached to or integral with the sidewalls 124. Alternatively, the partition rails 130 can be slidable on the sidewalls 124 so that they can be slid to either in front of the pusher 122 or behind the front lens 106 so that the partitions 140 can be added. In still further embodiments, the partitions 140 and partition rails 130 can be configured so that the partitions 140 can be added from the top of the sidewalls 124. Possible top load designs include partitions 140 where the slot of the attachment member 144 is expanded so that the partition 140 can deform enough to snap fit onto the partition rail 130. Alternatively, the slots of the attachment member 144 can be large enough to slide off of the partition rails 130 without deforming, but can be offset such that they only align properly for removal or addition when the partition 140 is twisted such that it is not perpendicular to the partition rails 130.

The partitions 140 have an asymmetrical shape comprising a low point 141 and a high point 142. This asymmetry permits the partitions 140 to be flipped relative to adjacent partitions 140 so that they are indexed. For example, the partitions 140 can be arranged so that the high point 142 of every even partition 140 is on the left side of the tray 102, and the high point 142 of every odd partition is on the right side of the tray 102. This indexing provides gaps and holds so that a user can easily separate the partitions.

Figure 5:
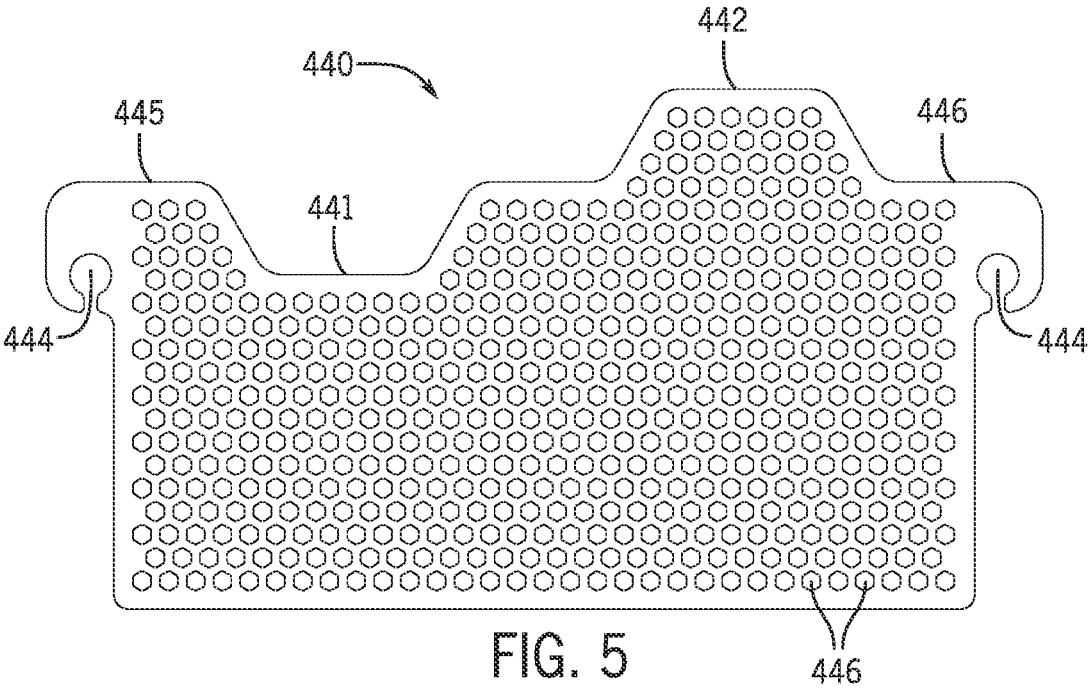
FIG. 5 is a front elevation view of a partition according to an alternative embodiment.

FIG. 5 illustrates a partition 440 according to an alternative embodiment. The partition 440 includes a plurality of holes 446. The holes 446 reduce the surface area of the partition 440, and the reduced surface area results in less area of contact with the cling wrapped product and therefore less resistance to removal. The holes 446 also reduce the amount of material needed to make the partitions 440, which reduces cost. The holes 446 can be any size or shape. In the preferred embodiment shown, the holes 446 are honeycomb shaped so as to maximize their area.

Figure 7:
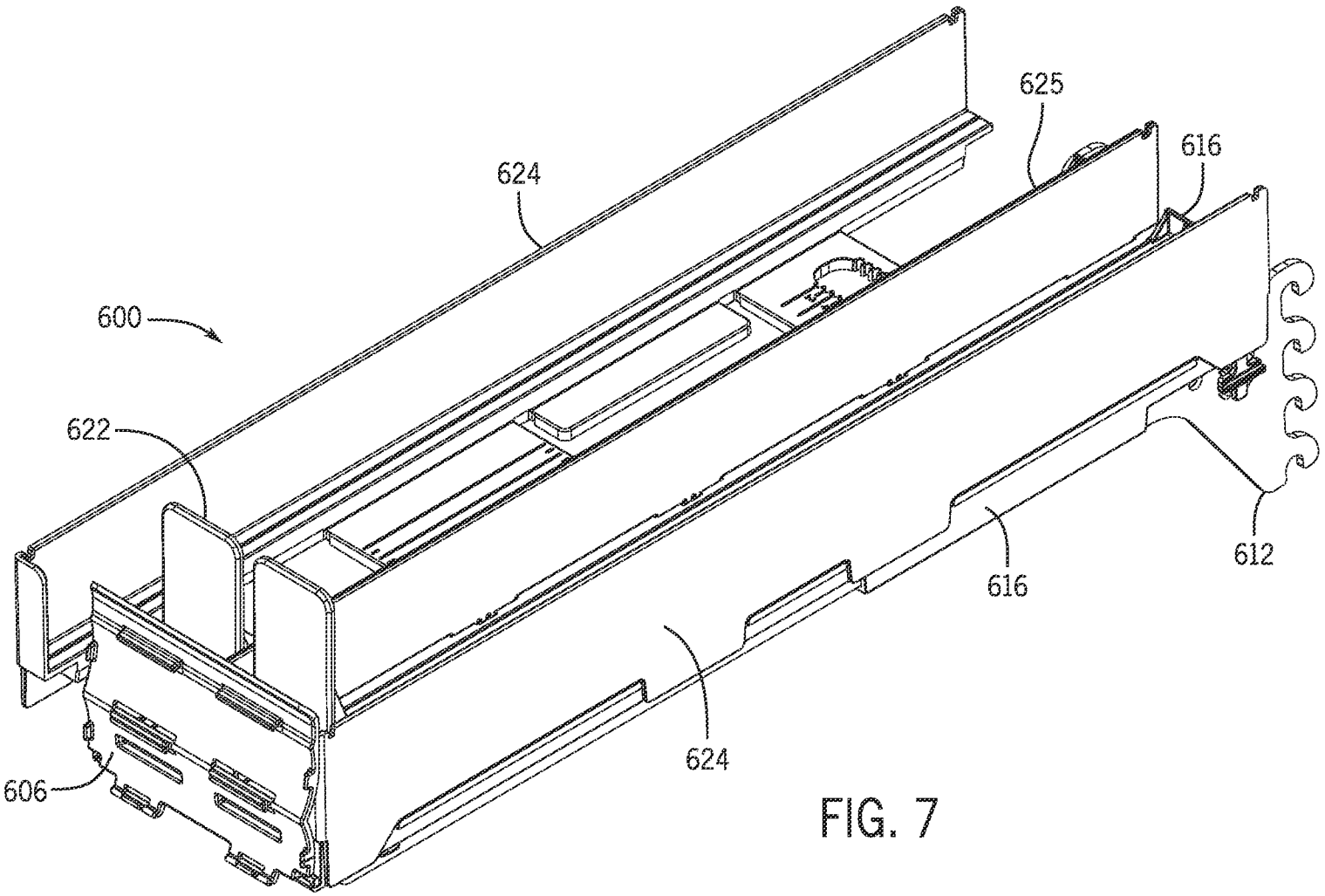
FIG. 7 is a perspective view of a multi-channel merchandiser.

The partition system described above can also be used in a multi-channel merchandiser. A multi-channel merchandiser 600 is shown in FIG. 7. In addition to the two sidewalls 624, the multi-channel merchandiser 600 has at least one divider 625 dividing the tray into multiple channels. In some embodiments, each channel includes a pusher 622. An example of a multi-channel merchandiser can be found in U.S. Patent Application Publication No. 2018/0360233. The partition rails 130 can be added to the sidewalls 624 of the multi-channel merchandiser 600 as described above. In addition, a central partition rail could be added to the central divider 625. A central partition rail comprises two parallel attachment members 134 that are separated by enough space to prevent the partitions 140 in adjacent channels from interfering with each other. In operation, the partitions 140 operate in the same way as described herein above.

In either the multi-channel merchandiser 600 or the product display merchandiser 100, the sidewalls 124, 624 can be adjustable to adjust the width of the channels. Examples of adjustable sidewalls can be seen in U.S. Pat. No. 7,681,744. In these embodiments, the width of the partitions 140 are also adjustable. Adjustable partitions 140 comprise partition wings 145, 146 that are separate pieces slidably attached to the main body of the partition 140. In some embodiments, both partition wings 145, 146 are slidably attached to the main body. In alternative embodiments, only one partition wing 145 or 146 is slidably attached to the main body, and the other wing is integrated into the main body.

In alternative adjustable-width merchandisers, the partitions 140 are slidably coupled to the floor of the tray 102. The partition rails 130 are designed to be inserted into the tray 102. The partition rails 130 include a central channel for receiving the pusher 122 and attachment members 134 for slidably attaching to the partitions 140. With the partition rails 130 and partitions 140 not attached to the sidewalls 124, the sidewalls can be pulled away from one another and the width of the product display merchandiser can be adjusted.

In still further embodiments, the product display merchandiser 100 is angled downward. This downward angle results in the products being biased towards the front lens 106 by gravity. In one example, the angle of the tray is between zero and ten degrees (0°-10°) with respect to horizontal. In a particular example, the angle of the tray is between three and seven degrees (3°-7°) with respect to horizontal. In some gravity-fed embodiments there is no pusher, as the weight of the products is enough to self-face. In alternative embodiments, a pusher is included and either biased by a coil spring, as described above, or simply weighted such that it is biased by gravity.

Figure 8:
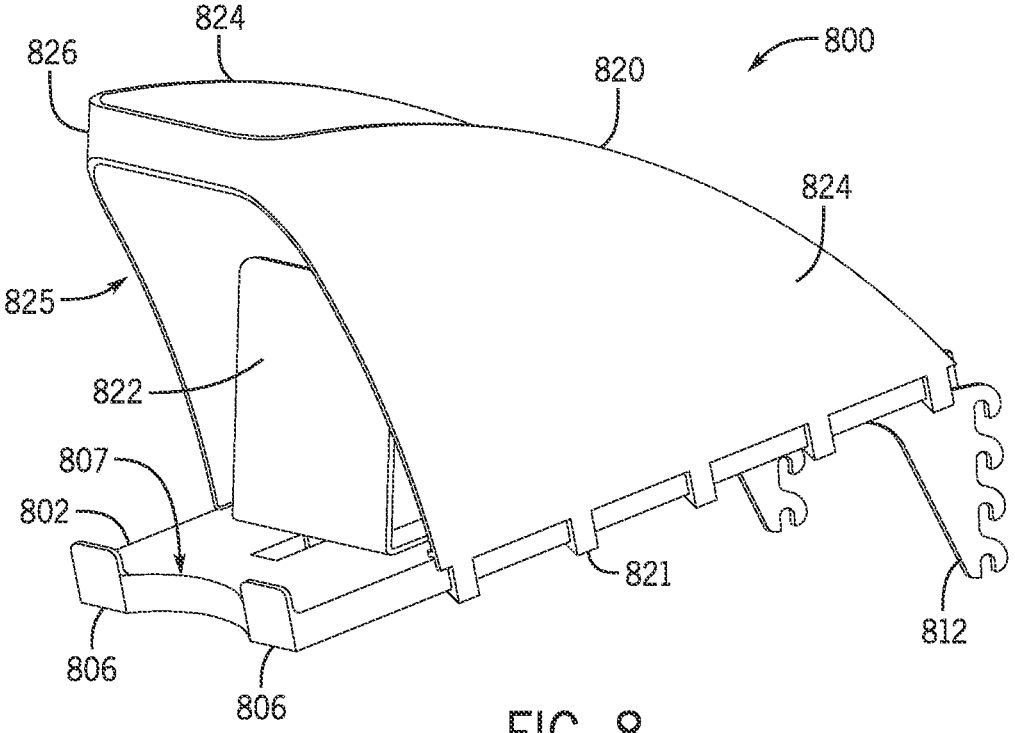
FIG. 8 is a perspective view of a product display merchandiser according to some embodiments of the present disclosure.

Turning to FIG. 8, another example of a product display merchandiser 800 is shown. The product display merchandiser 800 has a product support 802 and a shroud 820 which together form a tray. The product support 802 is sloped downward such that gravity biases products supported thereon towards the front end of the product display merchandiser 800. The shroud 820 is detachably coupled to the product support 802 by engagement members 821. In the shown form, the engagement members 821 are downwardly projecting, resilient protrusions configured to form a snap fit engagement with the product support 802.

The shroud 820 is formed of a single piece of plastic, such as through extrusion or injection molding. The shroud 820 includes two sidewall portions 824 and a front portion 826. The front portion 826 operates as a higher (or upper) product stop by engaging the front-most product contained within the product display merchandiser 800 proximate a top end thereof. The product support 802 includes one or more lower product stops 806, which engage the front-most product proximate a bottom end thereof. In the present example, the rigid lower product stops 806 define a recess 807 therebetween to allow a user to grip the forwardmost product in the product channel to dispense same. In some forms, the rigid lower product stops 806 have an L-shaped cross section and thus form a vertical lip that the product must be lifted over to dispense same from the product channel. In some forms, the lower product stops 806 are integral with the product support 802. In alternative forms, the lower product stops 806 are detachably coupled to the product support 802.

One or more engagement members 812 are configured to detachably couple the product display merchandiser 800 to a shelving system. The illustrated engagement members 812 are configured to suspend the product display merchandiser 800 from a wire grid (such as the wire grid of FIG. 11). In alternative forms, the engagement members 812 are configured to detachably couple to bars, slat walls, pegboards, and/or shelf top rail systems.

A pusher 822 slidingly engages the product support 802. The pusher 822 is biased toward the lower product stops 806. The biasing force is imparted by the combination of a light spring and gravity. The use of a light spring enables the product display merchandiser 800 to display delicate products that may be damaged by a merchandiser having a traditional pusher spring with a greater spring constant. In one form, the light spring has a spring constant and spring length configured such that the maximum biasing force is less than about 5 pounds. In a preferred form, the maximum biasing force is less than 1 pound. The front face of the pusher 822 is angled backward such that the top edge of the pusher 822 is further from the front end of the product display merchandiser 800 than the bottom edge of the pusher 822 is. The angled front face of the pusher 822 is positioned in direct contact with the displayed product and orients the displayed product in a desired orientation for viewing and dispensing. In operation, the rear products, such as containers of produce, rest against the pusher 822 at approximately the same angle as the front face of the pusher 822.

Thus, the product display merchandiser 800 includes a tray (product support 802 and shroud 820) having opposing sidewall portions 824 and defining a product support channel with a front or forward-facing opening 825 from which product displayed in the tray is to be merchandised. The product display merchandiser 800 includes a mount (such as engagement members 812) for supporting the tray and mounting same to a support surface, the mount angling the tray so that a forward portion of the tray is suspended below a rear portion of the tray to assist with feeding product out of the tray. The product display merchandiser 800 also includes a light spring-biased pusher 822 positioned within the product channel defined by the tray for gently advancing product through the tray as a front-most product is removed from the front or forward-facing opening 825 of the product channel.

When the front-most product engages the lower product stops 806, the pushing force of the pusher, by way of the other products, creates a torque on the front-most product about the lower end thereof, causing the front-most product to pivot forward until the top end thereof engages the rear face of the front portion 826 of the shroud 820. This pivoting pulls apart the front-most product from the product directly behind it in a direction of merchandising, thus reducing shearing force on the packaging when the product is removed. To remove the product, the product is lifted until the bottom end of the product clears the lower product stop 806. The product is then pulled forward through the opening between the lower product stops 806 and the front portion 826 of the shroud 820. This operation is further described with respect to the product display merchandiser 1000 below.

Figure 9:
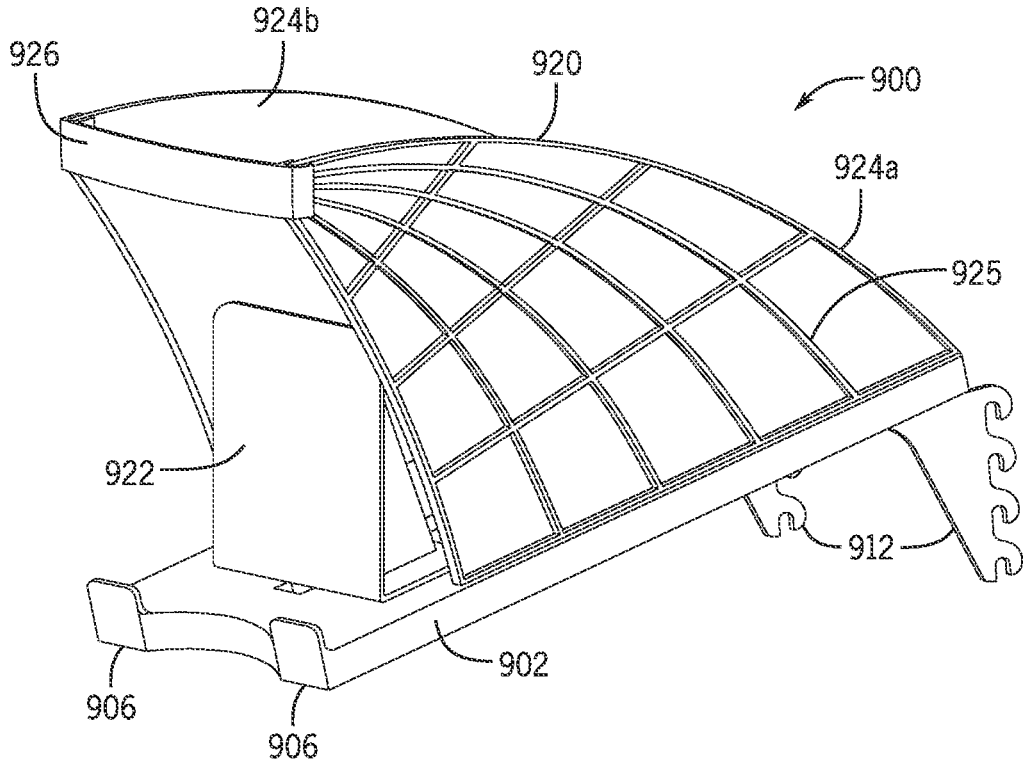
FIG. 9 is a perspective view of a product display merchandiser according to some embodiments of the present disclosure.

Turning to FIG. 9, the product display merchandiser 900 shown therein includes a product support 902, multi-piece shroud 920, pusher 922, and engagement members 912. The product support 902 includes lower product stops 906 configured to engage the front-most product displayed in the product display merchandiser 900 proximate a bottom end of said product. The product support 902 is sloped downward such that gravity biases products supported thereon towards the front end of the product display merchandiser 900. In operation, the product support 902, pusher 922, and engagement members 912 work in substantially the same manner as the corresponding components of the product display merchandiser 800 described above.

The shroud 920 is formed of two sidewalls 924*a*, 924*b* and a front member 926. The front member 926 is configured to detachably couple to both of the sidewalls 924*a*, 924*b*. In one form, the front member 926 includes a resilient engagement portion for forming a snap fit engagement with the sidewalls 924*a*, 924*b*. The front member 926 operates as a higher product stop which, in conjunction with the lower product stops 906, restricts forward movement of the products. The sidewalls 924*a*, 924*b* include engagement structures for detachably coupling to the product support 902. In operation, the assembled shroud 920 operates substantially similar to the shroud 820 described above.

The sidewalls 924*a*, 924*b* include a plurality of raised ribs 925. The raised ribs 925 increase the strength of the sidewalls 924*a*, 924*b* allowing the sidewalls 924*a*, 924*b* to be formed with less material than the ribless sidewall portions 824 shown in FIG. 8. In some forms, other portions of the product display merchandiser 900 include ribs 925, thus further reducing the required material to manufacture the product display merchandiser 900.

Figure 10:
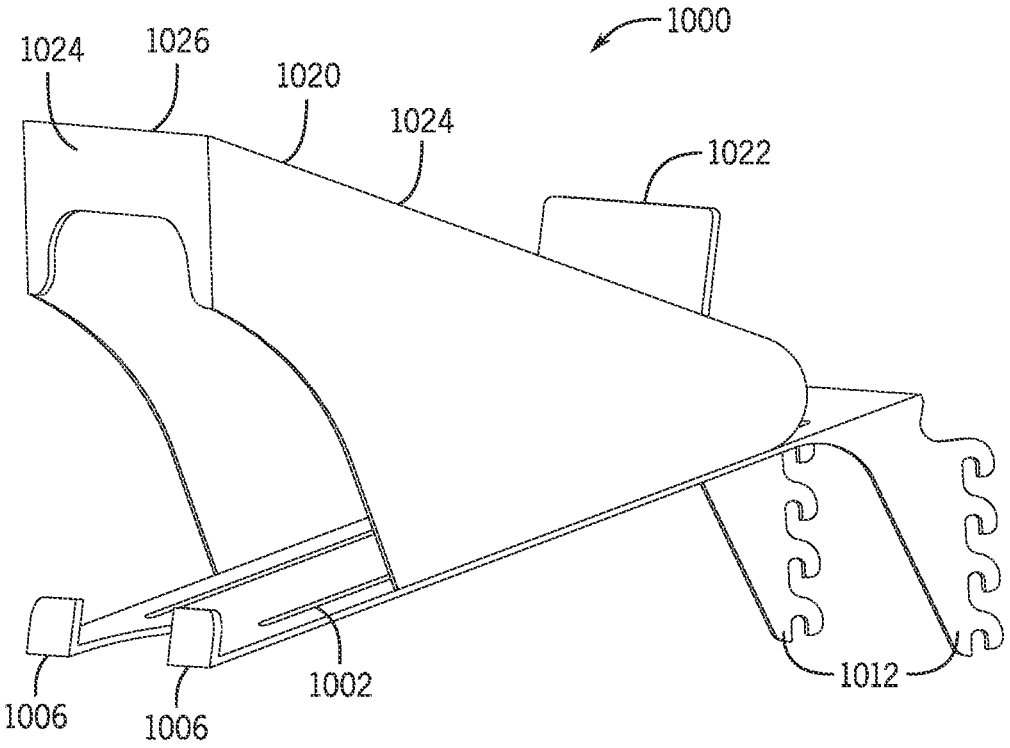
FIG. 10 is a perspective view of a product display merchandiser according to some embodiments of the present disclosure, with the merchandiser being transparent to better illustrate an interior portion.
Figure 11:
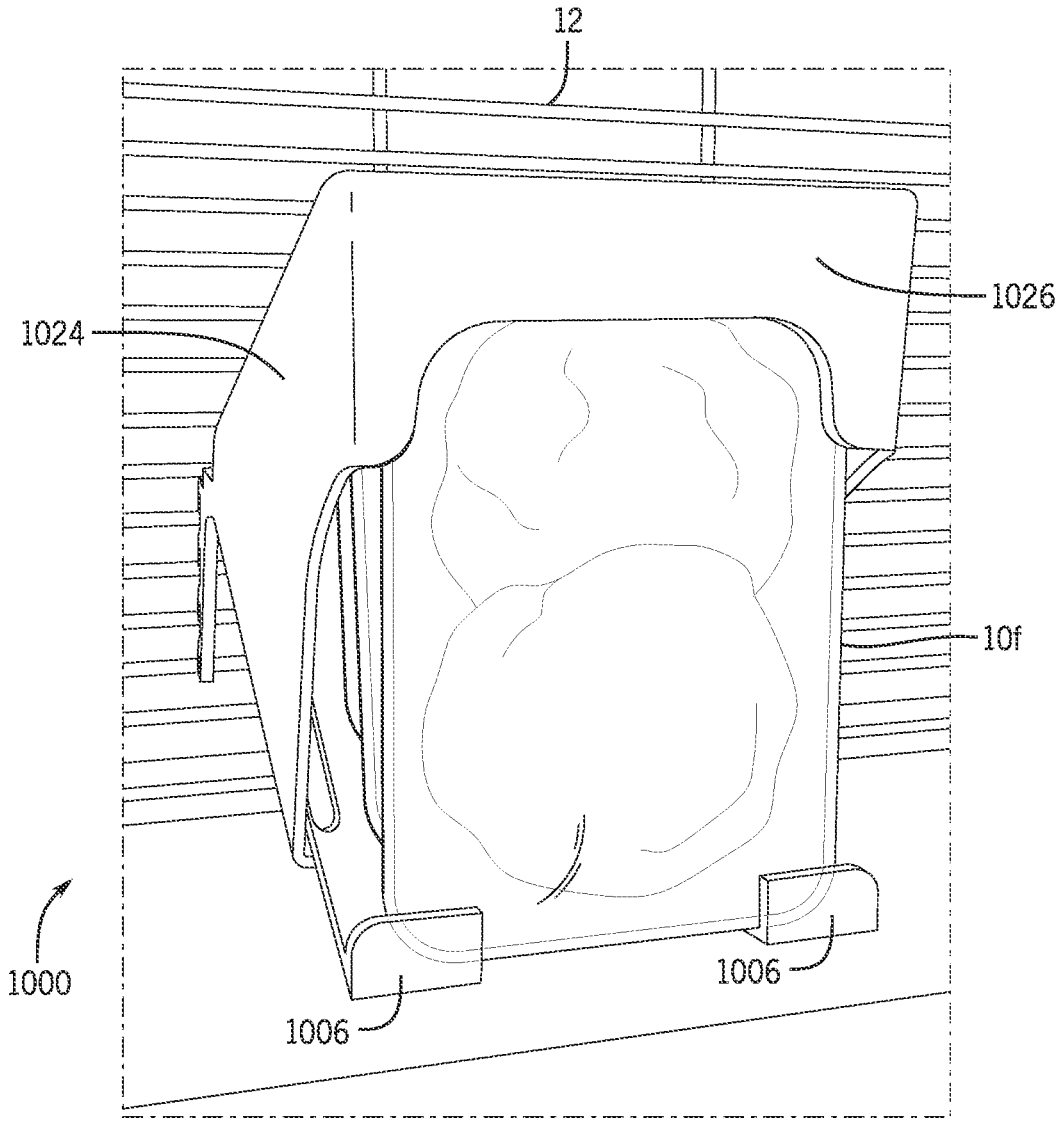
FIG. 11 is a perspective view of the product display merchandiser of FIG. 10 displaying products.
Figure 12:
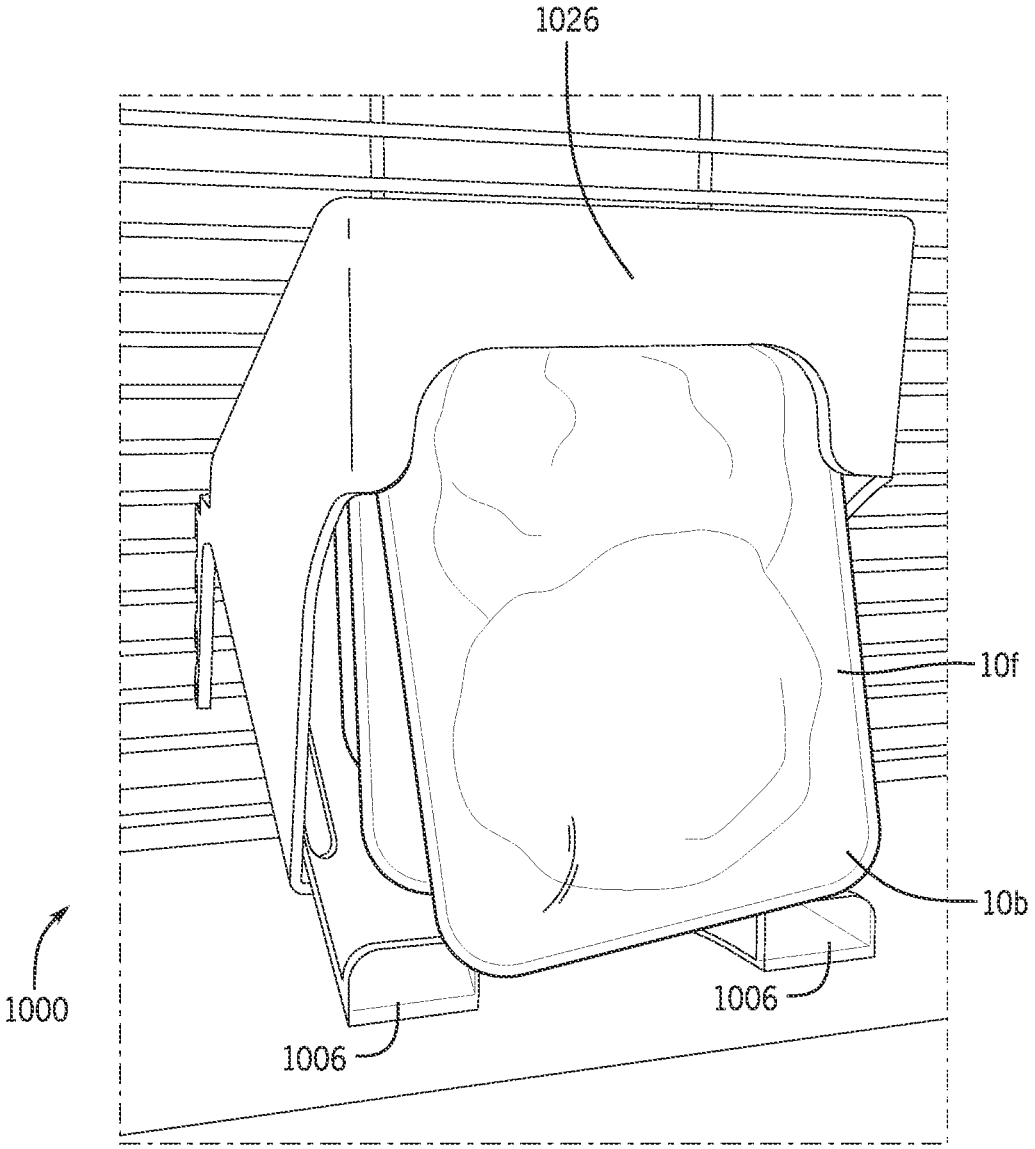
FIG. 12 is a perspective view of the product display merchandiser of FIGS. 10 and 11 with a product being removed.
Figure 13:
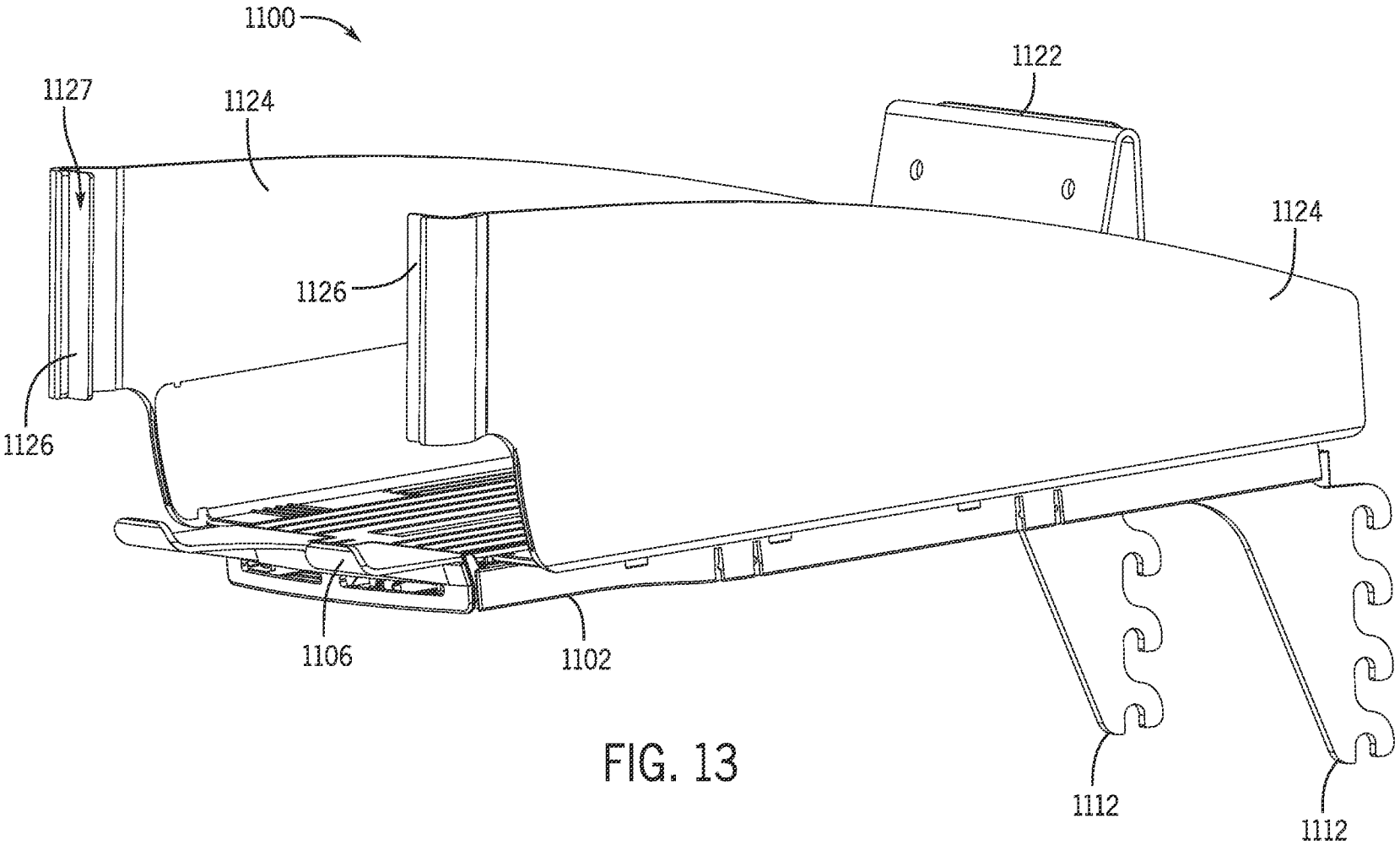
FIG. 13 is a perspective view of a product display merchandiser according to some embodiments of the present disclosure with a flexible gate forming an upper product stop.
Figure 14:
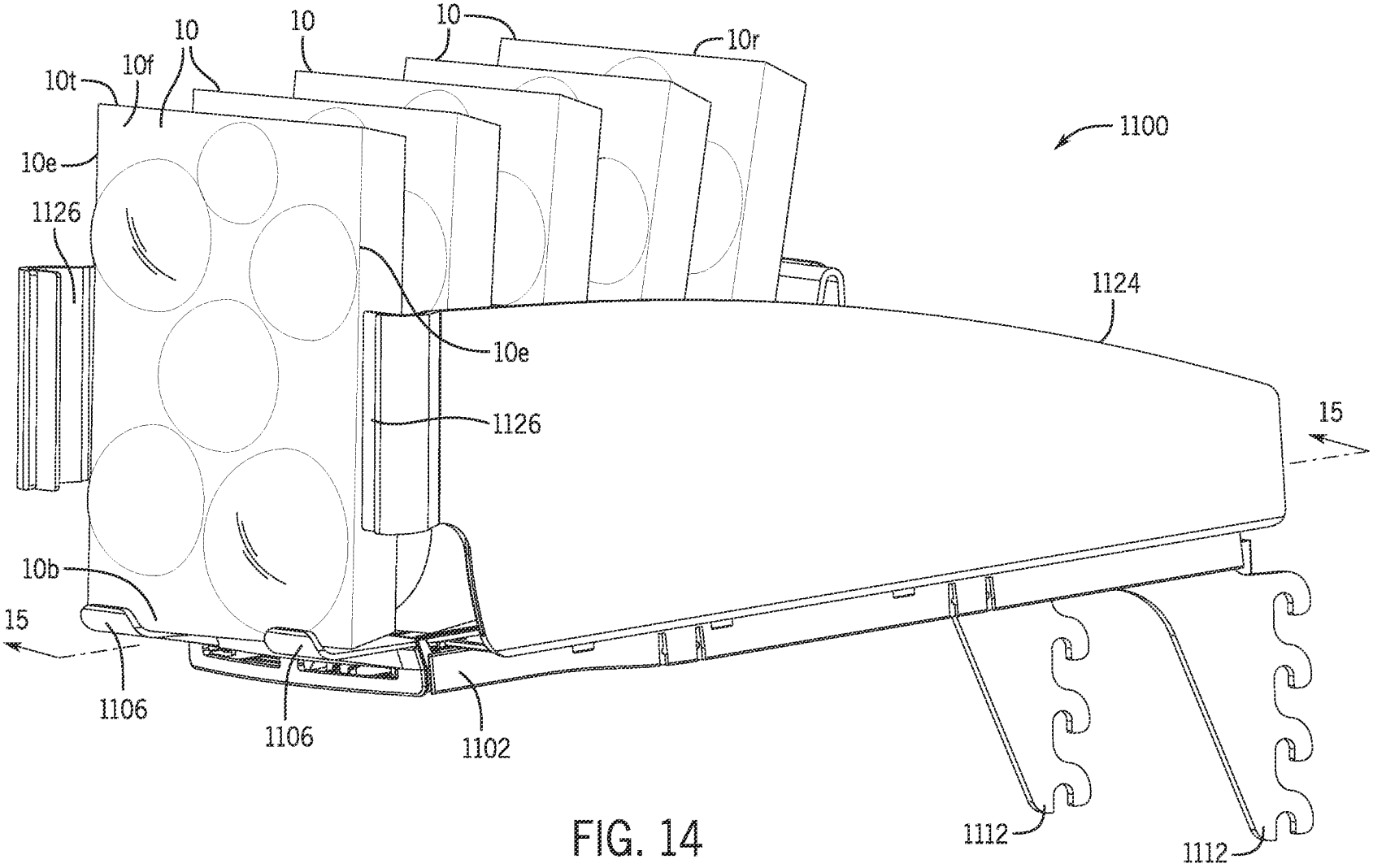
FIG. 14 is a perspective view of the product display merchandiser of FIG. 13 with added products.

FIGS. 10-12 illustrate another embodiment of a product display merchandiser 1000. The product display merchandiser 1000 includes a product support 1002, pusher 1022, shroud 1020, and engagement members 1012. The product support 1002 is sloped downward such that gravity biases products supported thereon towards the front end of the product display merchandiser 1000. The product display merchandiser 1000 operates in substantially the same manner as the product display merchandisers 800, 900 described above. As shown in FIGS. 10-12, the engagement members 1012 detachably couple the product display merchandiser 1000 to a grid 12.

The shroud 1020 is formed of a substantially translucent or transparent material. The transparent shroud 1020 allows users to view the products contained within the product display merchandiser 1000 through the sidewalls 1024. In operation, a store associate can quickly determine how many products are loaded into the product display merchandiser 1000 to monitor the product display merchandiser 1000 for restocking.

The pusher 1022 is a gravity pusher. Gravity biases the pusher 1022 toward the lower product stops 1006 as a result of the downward slope of the product support 1002. In some forms, added weights are included on the pusher 1022 to increase the biasing force. Alternatively or additionally, the pusher 1022 includes a light coil spring further biasing the pusher 1022 toward the lower product stops 1006. As described above, the light coil spring has a spring constant and spring length (or merchandiser length) configured such that the maximum biasing force is less that about 5 pounds. In a preferred form, the maximum biasing force is less than 1 pound.

The front face of the pusher 1022 is angled backward, such that the top edge thereof is positioned further back than the bottom edge thereof. In operation, the products 10 nearest the pusher 1022 are oriented at an angle substantially similar to that of the front face of the pusher 1022. The front-most product 10*f* engages the lower product stops 1006 proximate the bottom end of the front-most product 10*f*. The biasing force from the pusher 1022 causes the front-most product 10*f* to tilt forward until the top end thereof engages the higher product stop or front portion 1026 of the shroud 1020 as shown in FIG. 11. The tilting of the product 10 pulls the front-most product 10*f* away from the product directly behind the front-most product, reducing the area of contact between the films wrapping the respective products 10.

As shown in FIG. 12, the front-most product 10*f* is removed from the product display merchandiser 1000 by lifting the front-most product 10*f* until the bottom end 10*b* thereof clears the lower product stops 1006. The bottom end 10*b* is then pulled forward, removing the front-most product 10*f* from the product display merchandiser 1000. Removing the front-most product 10*f* by pulling the front-most product 10*f* forward reduces shearing force between the front-most product 10*f* and the product directly behind it.

FIGS. 13-21 illustrate another product display merchandiser 1100 configured to allow forward removal of products 10 to reduce shearing between adjacent products 10. The product display merchandiser 1100 includes a product support 1102 and a pair of sidewalls 1124. The product support 1102 is sloped downward such that gravity biases products supported thereon towards the front end of the product display merchandiser 1100. The sidewalls 1124 extend upward from respective sides of the product support 1102 and are detachably coupled thereto. At the front end of the product support 1102, a rigid lower product stop 1106 extends upward to engage a bottom end 10*b* of the front-most product 10*f* to hinder inadvertent product dispensing from the product support 1102. Each sidewall 1124 has a side product stop 1126 disposed on the front end thereof.

The side product stops 1126 together form a flexible gate 1127, and the first and second movable stops 1126 are movable from a first position, in which the first and second movable stops 1126 restrict forward movement of a product, to a second position, in which the first and second movable stops 1126 do not restrict forward movement of the product. For example, the side product stops 1126 are movable from a first, inwardly projecting position in which the side product stops 1126 interfere with forward movement of the product 10, to a second, forwardly angled position in which the product 10 can be pulled forward through the flexible gate 1127. In some forms, the side product stops 1126 are formed of a resilient, deformable material. The deformable material deforms from the first position to the second position when the product 10 is pulled forward. After the product 10 is pulled clear of the side product stops 1126, the resiliency of the side product stops 1126 returns the side product stops 1126 to the first position.

Alternatively or additionally, the first and second movable stops 1126 are pivotally coupled to the first and second sidewalls 1224, respectively. As the front-most product 10*f* is pulled forward, the side product stops 1126 pivot out of engagement with the product, allowing the product to be removed. The side product stops 1126 are biased, such as by springs, back into the first position to interfere with the next product 10 in line, preventing it from being pushed out of the product display merchandiser 1100 by the pusher 1122.

The side product stops 1126 are longer vertically than they are wide. The vertical length allows the side product stops 1126 to be used with a variety of products having different heights. The narrow width focuses the braking force of the side product stops 1126 onto the sidewalls of the product container, minimizing surface area contact between the side product stops 1126 and the soft, film front of the product packaging. In some forms, the side product stops 1126 extend vertically for at least 25% of the height of the product 10. In some forms, the side product stops 1126 extend vertically for at least 50% of the height of the product 10.

Figure 16:
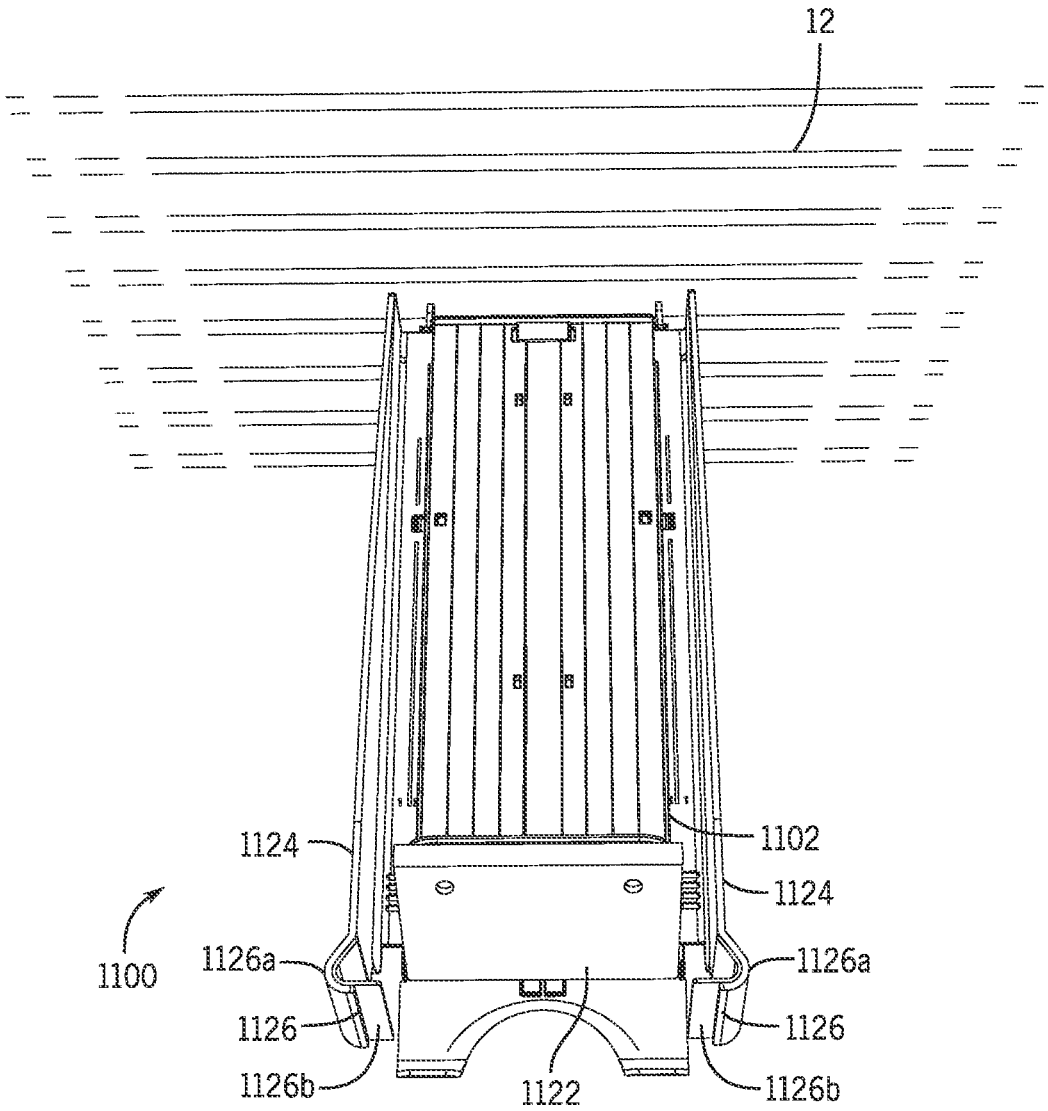
FIG. 16 is a top perspective view of the product display merchandiser of FIGS. 13-15 with the product support in a retracted position.

The side product stops 1126 are formed of a two piece construction, for example including a rigid outer body with a flexible inner liner that extends further into the product channel than the remainder of the rigid outer body. As best shown in FIG. 16, an outer rigid portion 1126*a* of the side product stops 1126 is integral with the sidewalls 1124. A flexible soft material, such as a soft rubber, is applied to an inner surface of the rigid portion as a flexible portion (or flexible liner) 1126*b*. When viewed in cross-section from above, the outer rigid portion 1126*a* has a straight portion formed by the sidewall 1124 and a U-shaped distal end. The flexible portion 1126*b* is connected to an inner face of the U-shaped distal end and tracks the U-shape of the U-shaped distal end. The flexible portion 1126*b* of the side product stops 1126 extends further inward toward the product support 1102 than does the outer rigid portion 1126*a*. The flexible portion 1126*b* of the side product stops 1126 engages the product 10. In some forms, the flexible portion 1126*b* is adhered to the outer rigid portion 1126*a*. Alternatively or additionally, one or more fasteners, such as screws, bolts, or rivets, secure the flexible portion 1126*b* to the outer rigid portion 1126*a*.

Figure 15:
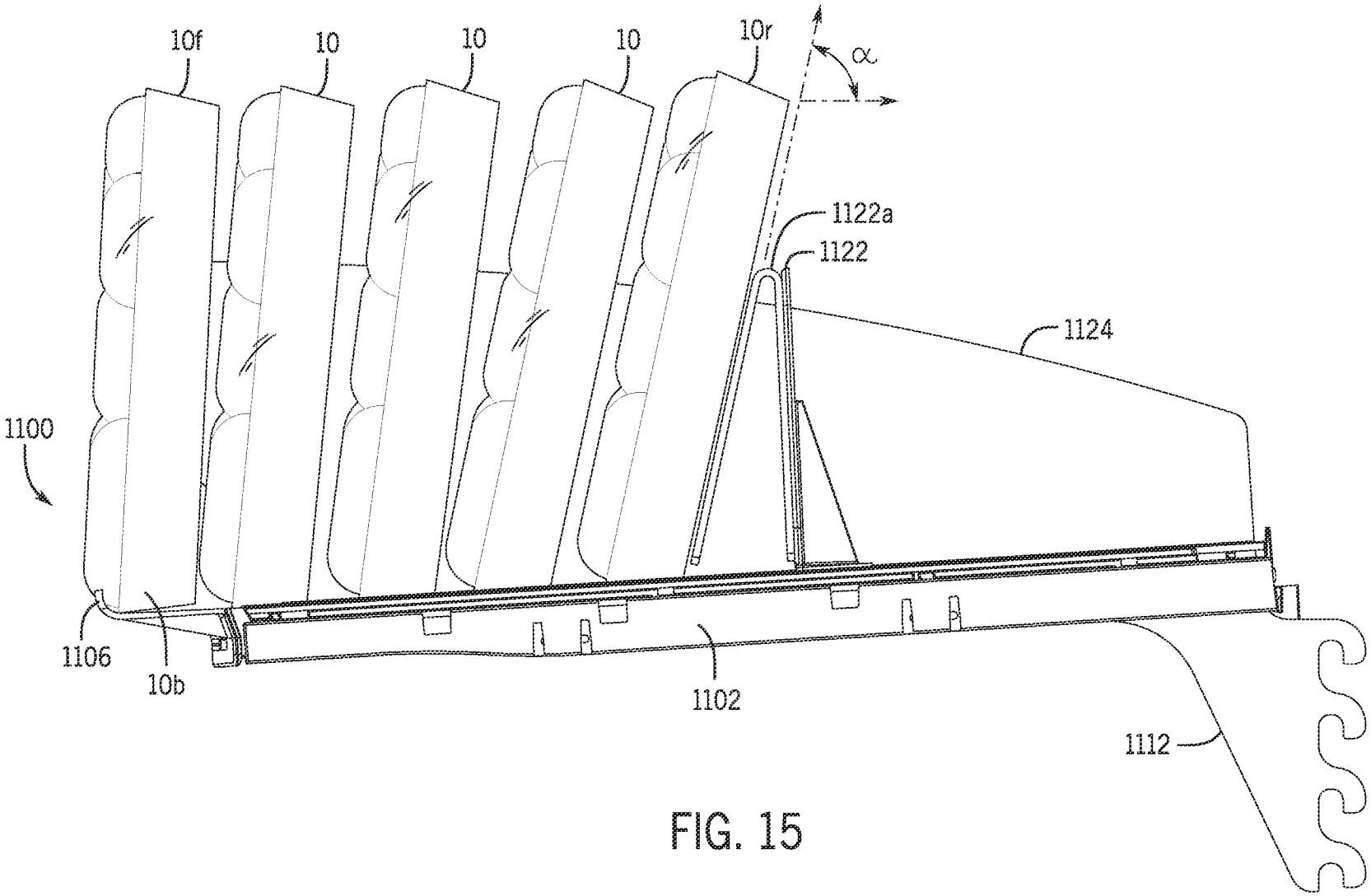
FIG. 15 is a cross section of the product display merchandiser of FIG. 14 taken along the line 15-15.

The pusher 1122 is biased toward the front end of the product display merchandiser 1100, e.g., toward the lower product stops 1106, by a light biasing spring. Turning to FIG. 15, it can be seen that the front face of the pusher 1122 is angled backward at an angle α relative to the horizontal. As such, the top edge of the pusher 1122 is positioned further back in the horizontal than the bottom edge of the pusher 1122. In some forms, the angle is achieved by an angled attachment 1122*a* coupled to a vertical pusher 1122. As shown in FIG. 15, the angled attachment 1122*a* may be an accessory that is removably or irremovably connected to a conventional pusher 1122 such as by way of a snap fit, adhesive, and/or fasteners to create the angled front face of the pusher 1122. Alternatively, the pusher may be a single, angled body, as shown in FIGS. 8-10 and 22-23.

Referring again to FIG. 15, the rearmost product 10*r* rests against the pusher 1122 at substantially the angle α. During operation, the bottom end 10*b* of the front-most product 10*f* contacts the lower product stop 1106. The biasing force of the pusher 1122 causes the front most product 10*f* to pivot forward until the front-most product 10*f* engages the flexible gate 1127 (see FIG. 13). When engaging the flexible gate 1127, the front most product 10*f* is at an angle relative to the horizontal that is greater than the angle α. As shown in FIG. 15, the front-most product 10*f* is angled forward relative to the product 10 directly behind the front-most product 10*f*. As such, the products 10*f*, 10 engage proximate the bottom ends thereof, but are spaced apart by an increasing amount further up the height of the products 10*f*, 10. This difference in angles reduces the amount of surface area contact between the front-most product 10*f* and the adjacent product 10 behind it.

Figure 17:
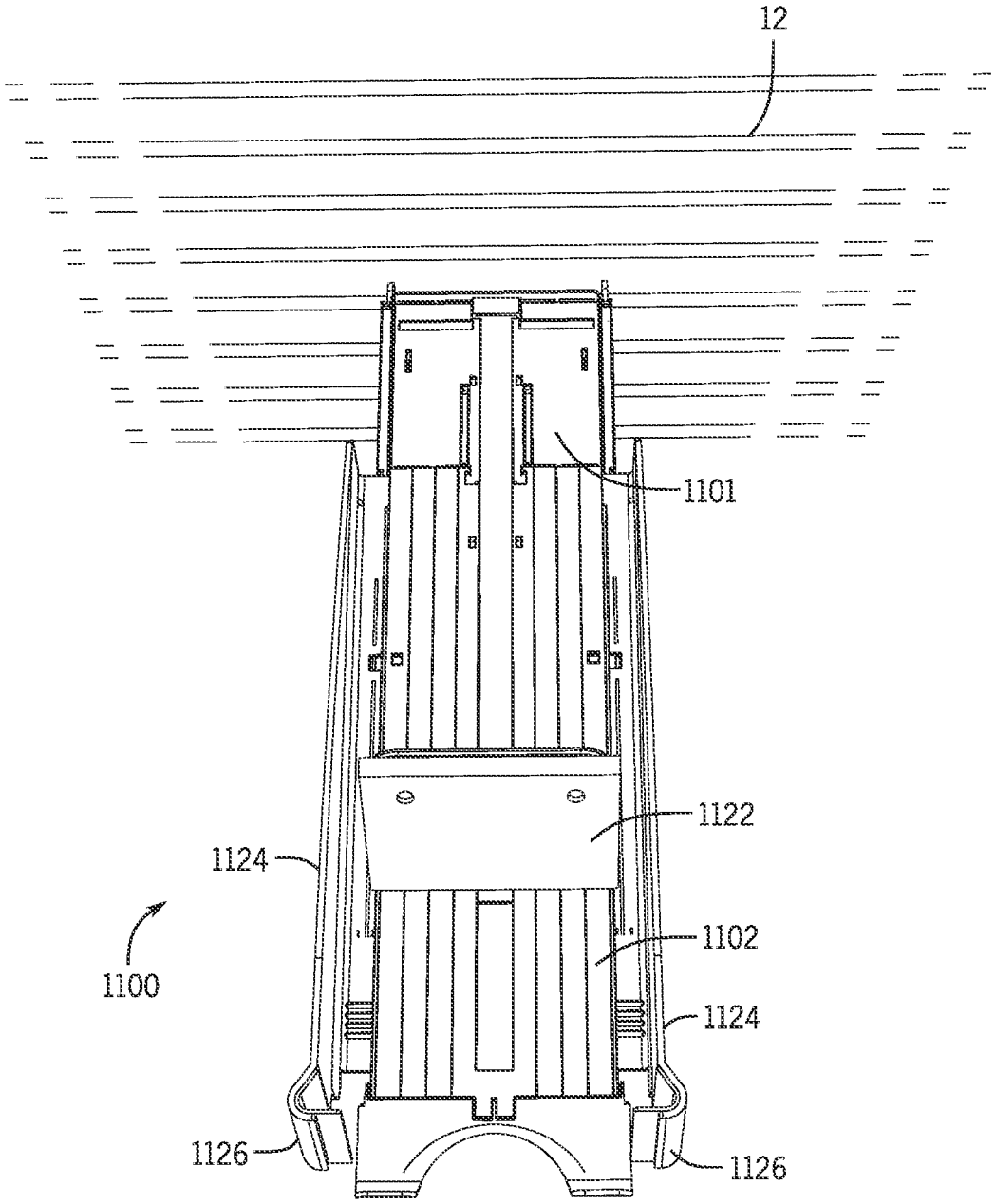
FIG. 17 is a top perspective view of the product display merchandiser of FIGS. 13-16 with the product support in an extended position.

The product support 1102 is slidable relative to a base 1101 from a first, retracted position (as shown in FIG. 16) to a second, extended position (as shown in FIG. 17). In the retracted position, the product display merchandiser 1100 is configured to display products as described above. In the extended position, the product display merchandiser 1100 is configured to be restocked by a user. In some forms, the product display merchandiser 1100 includes a releasable lock for securing the product support 1102 in the retracted position. The lock is released by actuating an actuator, such as a button on a side or bottom of the product display merchandiser 1100, allowing the product support 1102 to be slid outward relative to the base 1101.

Figure 19:
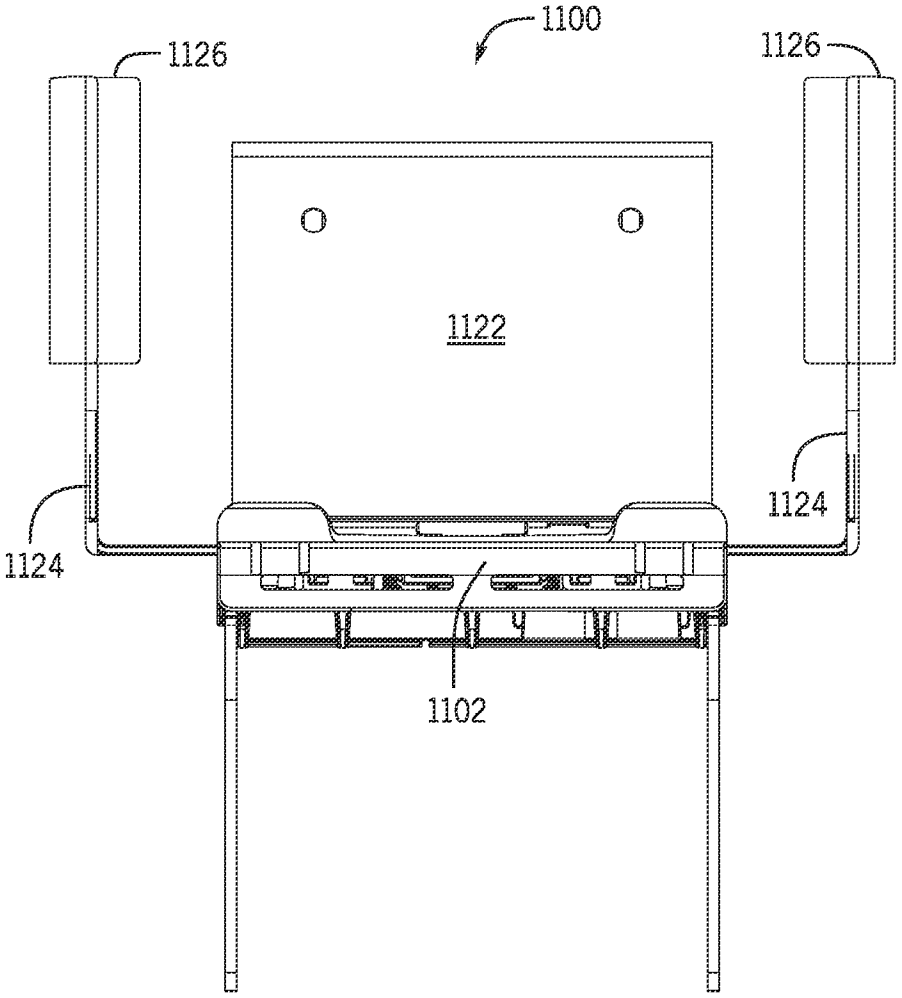
FIG. 19 is a front elevation view of the product display merchandiser of FIGS. 14-18 with the sidewalls in an extended position.
Figure 18:
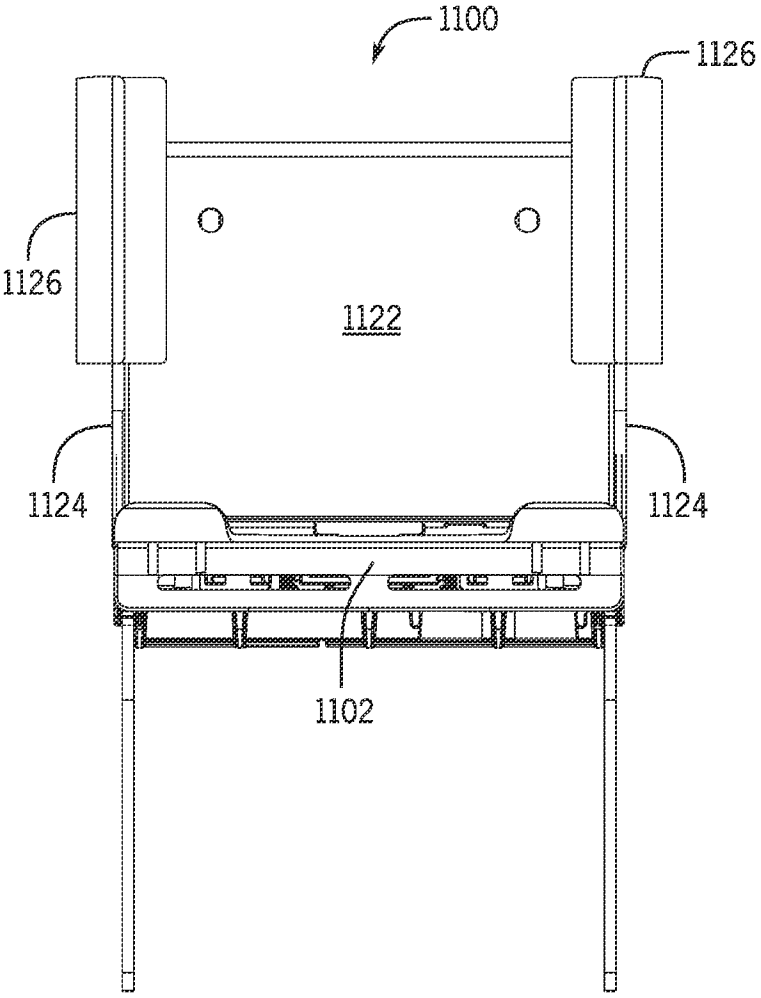
FIG. 18 is a front elevation view of the product display merchandiser of FIGS. 14-17 with the sidewalls in a retracted position.
Figure 20:
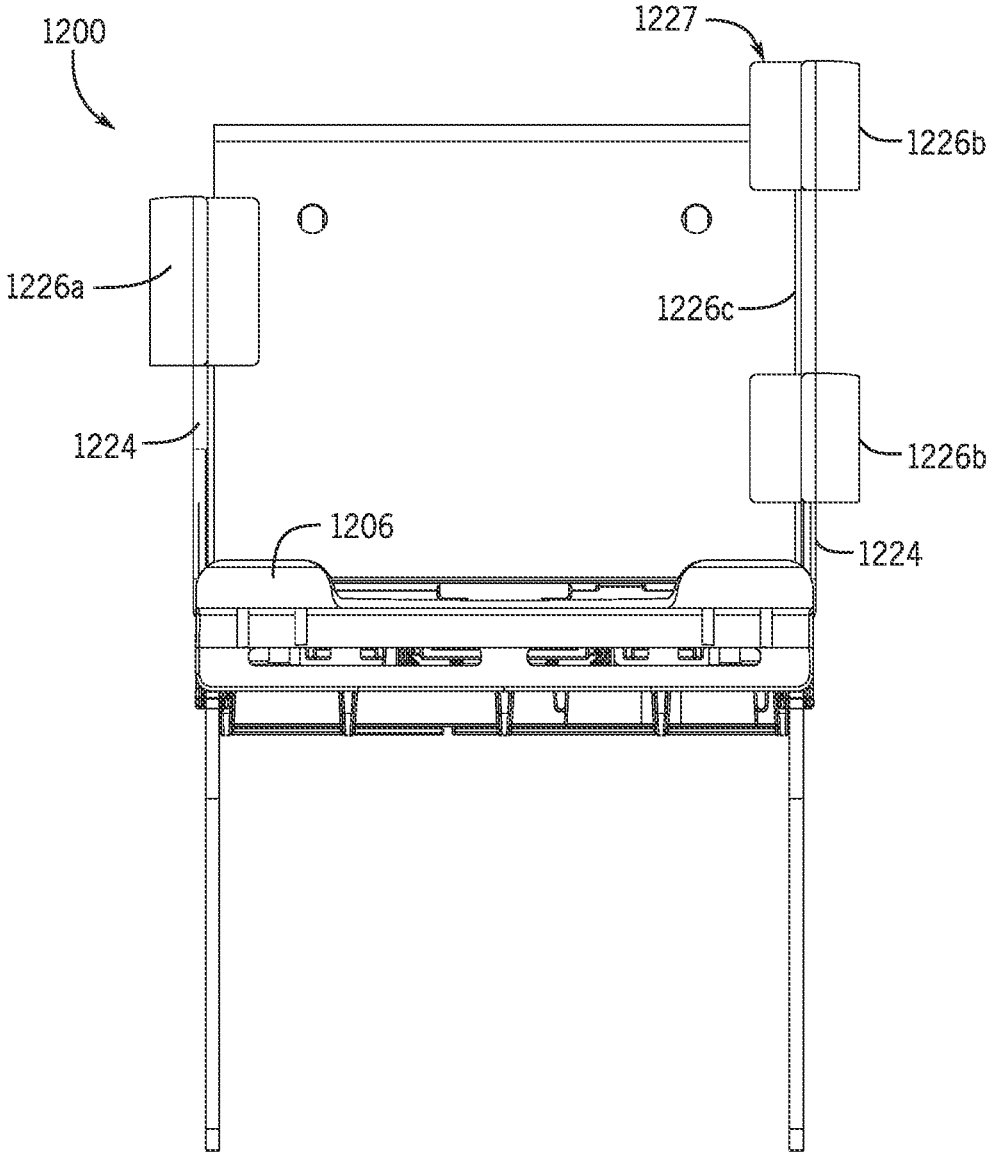
FIG. 20 is a front perspective view of a product display merchandiser according to some embodiments of the present disclosure with a nesting flexible gate forming an upper product stop.

Alternatively or additionally, one or both sidewalls 1124 are slidable relative to the product support 1102 from a first, retracted position (as shown in FIG. 18) to a second, extended position (as shown in FIG. 19). In some forms, the sidewalls 1124 are infinitely adjustable between the retracted and extended positions. Sliding the sidewalls 1124 relative to the product support 1102 allows for the width of the product display merchandiser 1100 to be adjusted. Adjusting the width of the product display merchandiser 1100 allows a single product display merchandiser 1100 to be configurable to display products of different sizes/widths. In such an embodiment, the deformable product stops 1126 are connected to the opposing sidewalls 1124 of the product support 1102 and together both the opposing sidewalls 1124 and deformable stops 1126 are adjustable in width with respect to the product support 1102 to accommodate products of varying width.

Figure 21:
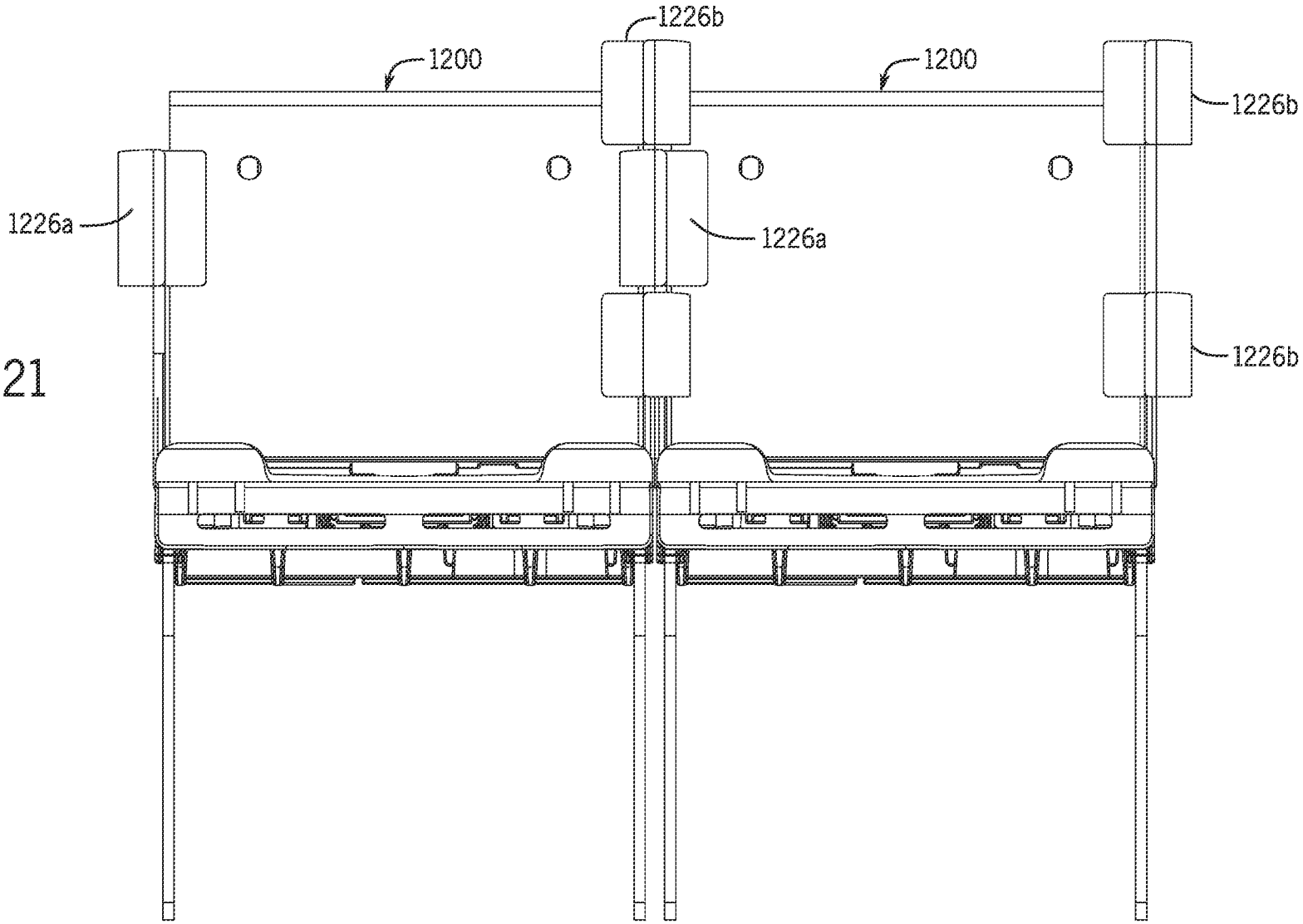
FIG. 21 is a front perspective view of two product display merchandisers of FIG. 20 illustrating the nesting of the flexible gates.

In the product display merchandiser 1100, the flexible gate 1127 is substantially symmetrical. In alternative embodiments, such as the product display merchandiser 1200 of FIGS. 20-21, the deformable stops are connected to the opposing sidewalls 1224 of the tray 1202 and are asymmetrical along their vertical axes to allow neighboring trays 1202 to nest with one another without increasing horizontal packout of planogram. For example, the flexible gate 1227 comprises a first product stop 1226*a* and a second product stop 1226*b*. The first product stop 1226*a* comprises a single portion of product stop. The second product stop 1226*b* comprises a plurality of portions of product stop, with a gap 1226*c* aligned vertically with the first product stop 1226*a*. As shown in FIG. 21, when two product display merchandisers 1200 are positioned adjacent one another, the first product stop 1226*a* of one product display merchandiser 1200 lines up with and is at least partially received in the gap 1226*c* of the second product stop 1226*b*. As such, the flexible gates 1227 of the adjacent product display merchandisers 1200 nest together to improve the horizontal packout of the planogram.

Other than the flexible gate 1227, the product display merchandiser 1200 is substantially similar to the product display merchandiser 1100 described above. The flexible gate 1227 serves as a higher product stop which, in conjunction with the lower product stop 1206, restricts forward movement of products supported by the product display merchandiser 1200. In operation, pulling on a top end of the front-most product causes the flexible gate 1227 to move from a first position to a second position, allowing the product to be removed in a forward direction from the product display merchandiser 1200.

FIGS. 22-25 illustrate another product display merchandiser 1300 having flexible product stops 1326 forming a flexible gate 1327. The product display merchandiser 1300 has a tray 1302 having two opposed sidewalls 1324 with a product support surface 1301 extending therebetween.

Figure 23:
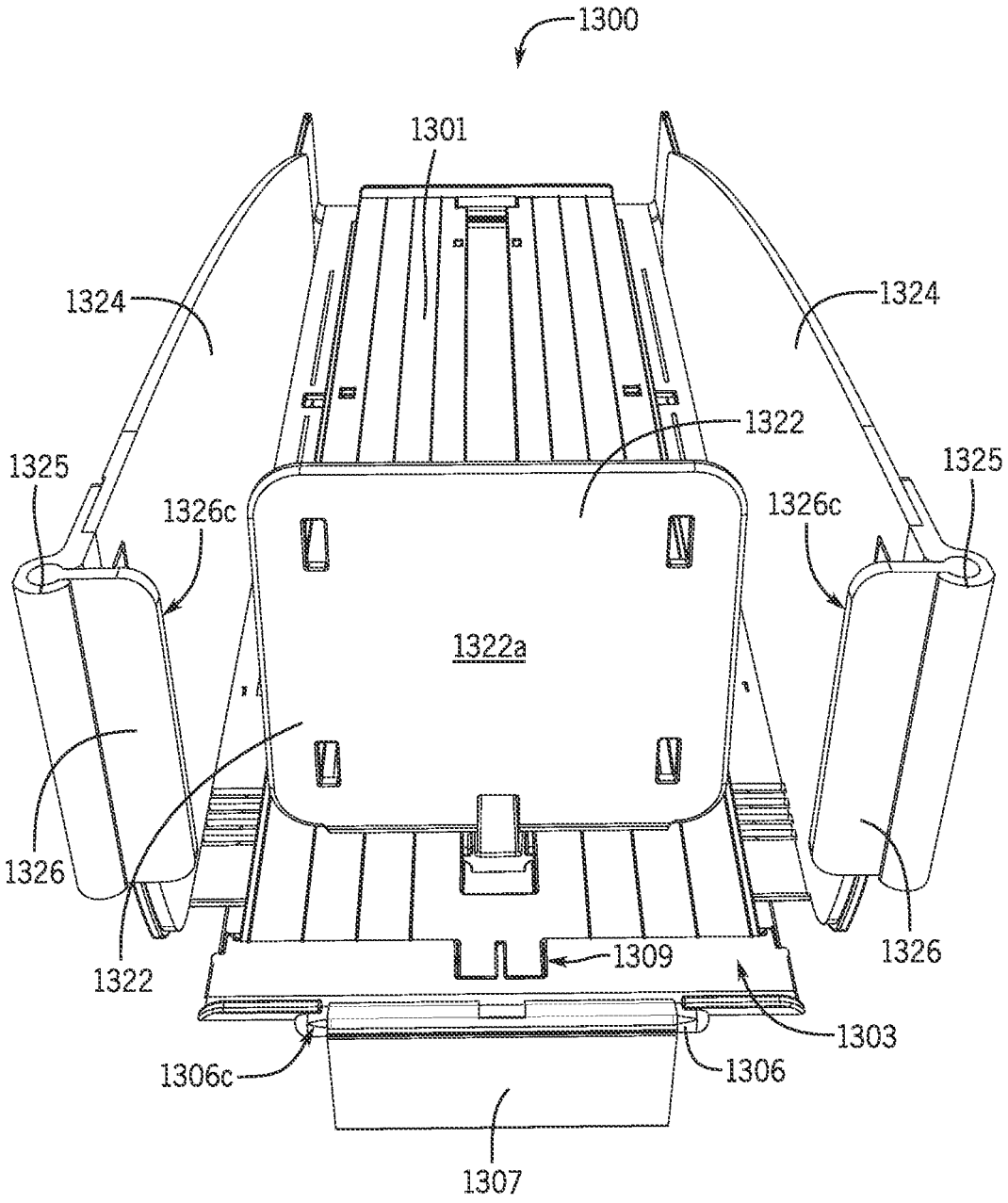
FIG. 23 is a front elevation view of the product display merchandiser of FIG. 22.

Product stops 1306, 1326 are arranged at the front of the tray 1302 to restrict forward movement of products contained therein. The front product stops include a pair of side stops 1326 (together forming a flexible gate 1327) and a lower product stop 1306. The lower product stop 1306 extends upward from (and/or with respect to) the front end of the product support surface 1301. For example, as shown in FIG. 23, the front product stop 1306 is attached to the front end 1303 of the tray 1302 by way of a hinge or a snap fit at 1309, and includes an upwardly curved lip at the front end thereof. In some forms, the lower product stop 1306 includes or has attached thereto a channel 1307 into which indicia, such as price tags, may be received.

A spring-biased pusher 1322 is movable along the product support surface 1301 and configured to bias products supported thereon towards the front product stops 1306, 1326 of the product display merchandiser 1300. As described with respect to other embodiments herein above, the front face 1322*a* of the pusher 1322 is angled backward relative to the front product stops 1306, 1326. In operation, the row of products is angled at substantially the same angle as the front face 1322*a* of the pusher 1322. When the front-most product 10*f* contacts the lower product stop 1306, the biasing force causes the product to pivot about the lip of the lower product stop 1306 until the product contacts the side product stops 1326. As shown in FIG. 15, this pivoting of the front-most product 10*f* partially separates the front-most product 10*f* from the product 10 immediately therebehind, reducing the cling force of the two products to each other.

Returning to FIGS. 22-25, in the present embodiment, the flexible side product stops 1326 are coupled to the front ends of the sidewalls 1324, respectively, by relatively more rigid product stop holders 1325. The side product stops 1326 are relatively flexible/deformable in comparison to the sidewalls 1324 and the product stop holders 1325. The side product stops 1326 are aligned with the product channel to prevent the product from unintentional dispensing from the tray 1302. The side product stops 1326 form a flexible gate 1327 traversing at least a portion of the product channel front opening.

Figure 25:
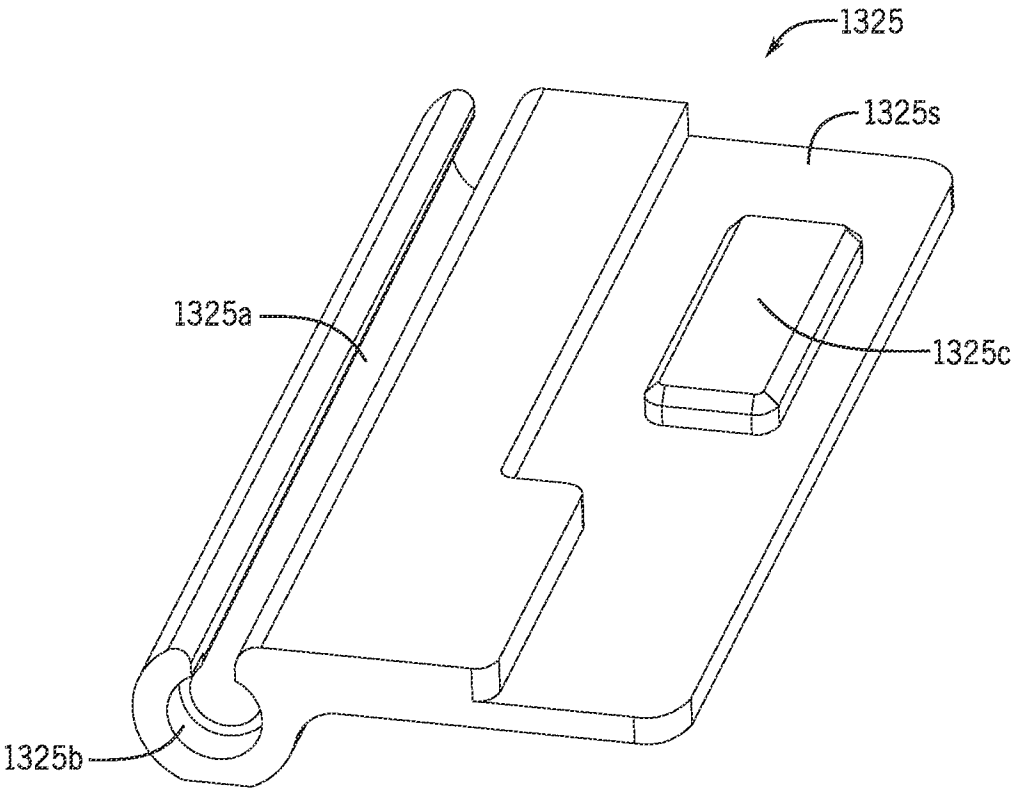
FIG. 25 is a bottom perspective view of a product stop holder of the product display merchandiser of FIGS. 22-24.
Figure 24:
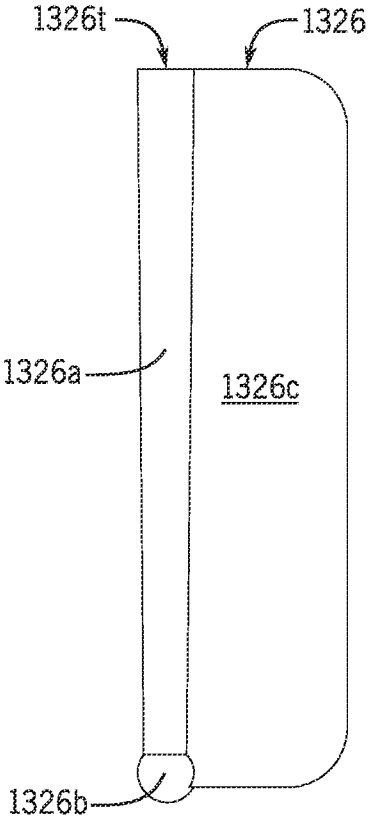
FIG. 24 is a front elevation view of a flexible product stop of the product display merchandiser of FIGS. 22-23.

As shown in FIG. 24, each side product stop 1326 includes a product-contacting portion 1326*c* and an engagement portion 1326*a* extending along one side thereof, which side is oriented vertically when installed on the product display merchandiser 1300. In one form, the engagement portion 1326*a* has a frustoconical shape, with the widest end being the top end 1326*t* thereof. In some forms, the engagement portion 1326*a* of the side product stop 1326 includes a locking ball 1326*b* at one end (here, the narrow bottom end) thereof. The diameter of the locking ball 1326*b* is substantially the same as (i.e., ±10%) the diameter of the widest portion (e.g., top end 1326*t*) of the engagement portion 1326*a*. As shown in FIG. 25, the product stop holder 1325 has a cavity 1325*a* shaped and sized to receive the engagement portion 1326*a* of the side product stop 1326. A second cavity 1325*b* within the first cavity 1325*a* of the product stop holder 1325 is configured to receive the locking ball 1326*b*, so as to restrict vertical movement of the side product stop 1326 relative to the product stop holder 1325 by virtue of the fact that the outer diameter of the locking ball 1326*b* is larger than the inner diameter of the narrow lower end of the first cavity 1325*a*. In other examples, no locking ball 1326*b* or second cavity 1325*b* is provided. In still other examples, the side product stop flap 1326 is co-molded over the end of the product stop holder 1325 rather than being connected thereto by way of the engagement portion 1326*a*. The product stop holder 1325 and/or side product stop 1326 are resilient, such that it/they can be deformed to allow insertion or removal of the side product stop 1326 and can then return to its/their static shape(s) once the deforming force is removed.

As noted, the side product stops 1326 are formed of a flexible or resilient material. The material that the side product stops 1326 are formed of is more flexible than the material the sidewalls 1324 are made of. In some examples, the product stop holders 1325 may be made of the same material as the sidewalls 1324, while the side product stops 1326 are made of a material having a lower elastic modulus than that of the sidewalls 1324. In other examples, the material of the product stop holders 1325 has an elastic modulus between that of the side product stops 1326 and that of the sidewalls 1324. For example, the side product stops 1326 may be made of rubber or another elastomeric material. In operation, a forward force on the side product stops 1326 causes the side product stops 1326 to deform. When the front-most product 10*f* in the tray 1302 is pulled forward, the side product stops 1326 deform so as to allow the product to be removed. As described herein above, removing the product in a forward direction reduces the friction between the product and the adjacent product, thus reducing instances of torn packaging. Once the front-most product 10*f* is removed, the resilient side product stops 1326 return to their static positions, as shown, to restrict forward movement of the next, adjacent product. In alternative forms, the side product stops 1326 are hingedly attached to the product stop holders 1325, such that the side product stops 1326 pivot forward when the product is pulled. The hinged product stops would be biased, such as spring-biased, to the shown static position, so as to restrict forward movement of the products when no forward pulling force is exerted thereupon.

Figure 22:
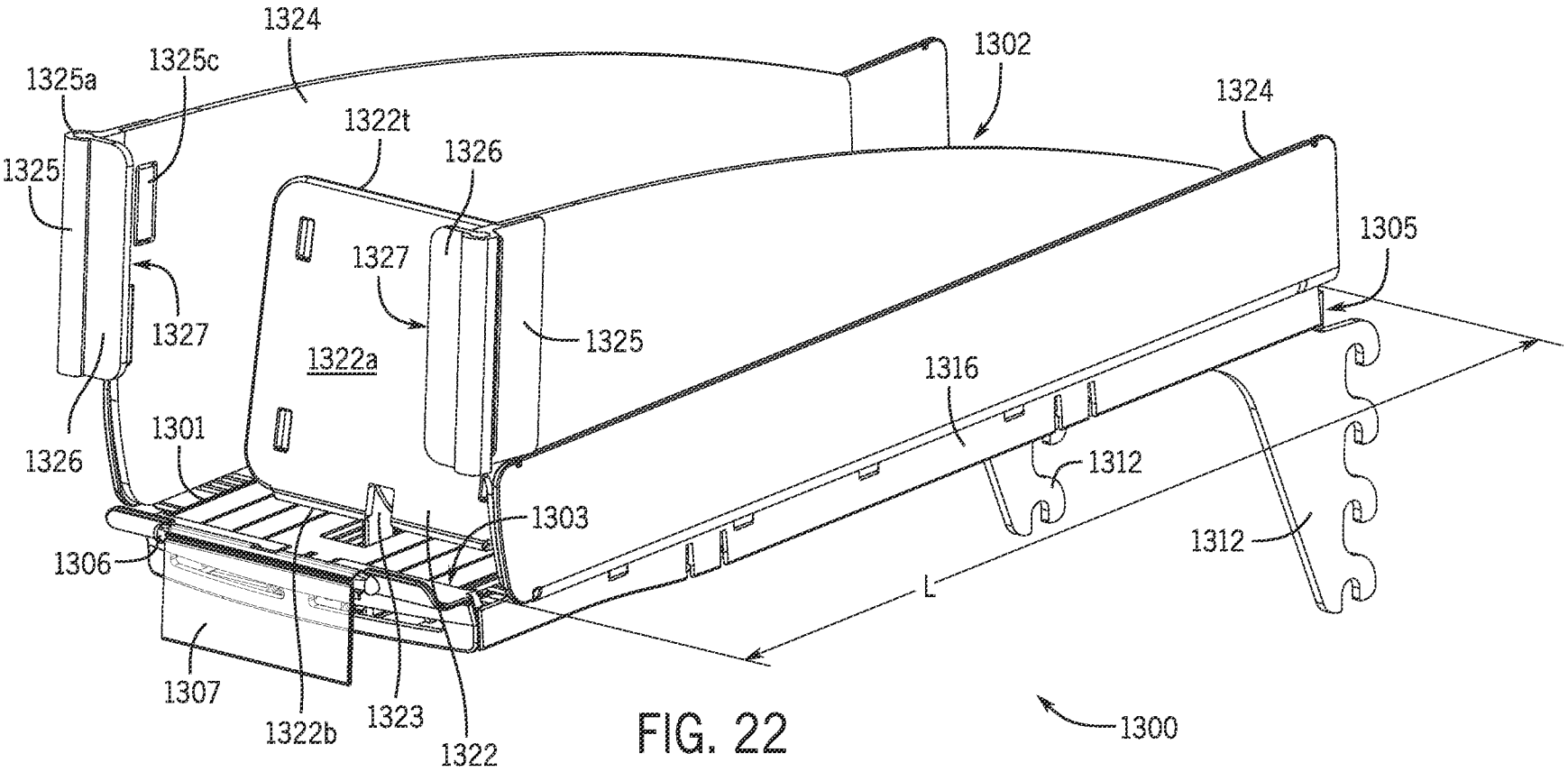
FIG. 22 is a front perspective view of a product display merchandiser according to some embodiments of the present disclosure having a flexible product stop.

Referring to FIGS. 22 and 25, the product stop holders 1325 are detachably coupled to the sidewalls 1324. The product stop holders 1325 include locking members 1325*c* on sidewall-engaging portions 1325*s* thereof, which locking members 1325*c* are configured to interlock with corresponding structure of the sidewalls 1324. In some forms, the locking members 1325*c* comprise projections configured to be received in correspondingly shaped and sized apertures of the sidewalls 1324. The locking members 1325*c* and the sidewalls 1324 are resilient, so as to form a snap fit engagement with each other. In alternative forms, the product stop holders 1325 are integrally formed with (such as molded as part of) the sidewalls 1324.

In some embodiments, the sidewalls 1324 are configured to reduce friction with products contained in the tray 1302. In some forms, the sidewalls 1324 are textured to reduce friction. The textured surfaces reduce the amount of surface area contact between the sidewalls 1324 and the products. Alternatively or additionally, the sidewalls 1324 are angled outwards, as shown in FIG. 23, to reduce contact with the products.

Thus, FIGS. 22-25 show a product display merchandiser 1300 comprising a product support, such as tray 1302 having product support surface 1301, and a pair of sidewalls 1324 extending upwardly on respective longitudinally extending sides of the product support. A first product stop 1306 extends upwardly from a front end 1303 of the product support and is configured to contact a bottom end 10*b* of a front-most product 10*f* (see FIG. 14) with which the product display merchandiser 1300 is to be stocked. A second product stop 1326 is coupled to at least one sidewall 1324 of the pair of sidewalls and is configured to contact at least one of a top end 10*t* and a side edge 10*e* of the front-most product 10*f* (see FIG. 14). In some examples, the second product stop 1326 comprises or forms a portion of a flexible gate 1327 configured to contact the side edge 10*e* and an opposing side edge 10*e* of the front-most product 10*f*. To that end, the product display merchandiser 1300 may comprise a third product stop 1326, and the second product stop 1326 is coupled to a first sidewall 1324 of the pair of sidewalls, and the third product stop 1326 is coupled to a second sidewall 1324 of the pair of sidewalls.

The second product stop comprises a flexible member 1326 made of a material that has a lower elastic modulus than that of the pair of sidewalls 1324. A product stop holder 1325 is attached to a front end of the at least one sidewall 1324 and is made of a material that has a higher elastic modulus than that of the flexible member 1326. The flexible member 1326 is detachably coupled to the product stop holder 1325. The product stop holder 1325 has a cavity 1325*a* configured to receive a portion 1326*a* of the flexible member 1326. The flexible member 1326 extends inward with respect to the at least one sidewall 1324 toward the product support and is configured to contact the side edge 10*e* of the front-most product 10*f*.

A pusher 1322 is longitudinally slidable relative to the product support and biased toward the front end 1303 of the product support to push product toward the first and second product stops 1306, 1326. Referring to FIG. 22, in some examples, a front face 1322*a* of the pusher 1322 is angled non-perpendicular to the product support (such as to support surface 1301) such that a bottom end 1322*b* of the pusher's front face 1322*a* is closer to the front end 1303 of the product support than a top end 1322*t* of the pusher's front face 1322*a*. A spring 1323 may be coupled to the product support and configured to bias the pusher 1322 toward the first and second product stops 1306, 1326. In one example, the spring 1323 has a spring constant and the product support has a longitudinal length L such that a maximum biasing force of the spring 1323 is less than or equal to 1 pound.

The product display merchandiser 1300 may further comprise an engagement member 1312 coupled to the product support for hanging the product display merchandiser 1300 from a support structure (such as but not limited to a grid 12, see FIG. 11). In some examples, the product support (or at least product supporting surface 1301) is sloped when the product display merchandiser 1300 is hung from the support structure such that a rear end 1305 of the product support is vertically higher than the front end 1303 of the product support. The product display merchandiser 1300 may be gravity-fed only, or the pusher 1322 may be biased by both gravity and a spring 1323.

In some examples, each sidewall 1324 in the pair of sidewalls is textured to reduce friction between each sidewall 1324 and products 10 with which the product display merchandiser 1300 is to be stocked. In some examples, the sidewalls 1324 in the pair of sidewalls are angled outward relative to each other and to the product support.

FIGS. 22-25 also show how the product display merchandiser 1300 comprises a tray 1302 having a product-supporting top surface 1301, a pair of sidewalls 1324 extending upwardly with respect to the top surface 1301 of the tray 1302 and along respective opposite, longitudinally extending sides of the tray 1302, and a pusher 1322 longitudinally slidable along the top surface 1301 of the tray 1302 and positioned between the sidewalls 1324 of the pair of sidewalls. The product display merchandiser 1300 comprises first and second product stops 1306 and/or 1326, each product stop 1306 and/or 1326 being coupled to at least one of the tray 1302 and a sidewall 1324 in the pair of sidewalls.

Each product stop 1306 and/or 1326 has a product-contacting surface configured to contact a front face of a front-most product 10*f* with which the product display merchandiser 1300 is to be stocked to inhibit removal of the front-most product 10*f* from the product display merchandiser 1300. Referring to FIG. 23, the product-contacting surface 1326*c* of the side product stops 1326 is the rear face of each inwardly-projecting flap thereof. The product-contacting surface 1306*c* of the product stop 1306 is the rear face of the upwardly-curved lip thereof. At least one of the first and second product stops 1306 and/or 1326 is movable such that its product-contacting surface 1306*c* and/or 1326*c* moves between a first orientation in which its product-contacting surface 1306*c* and/or 1326*c* is configured to contact the front face of the front-most product 10*f*, and a second orientation that allows the front-most product 10*f* to be pulled past its product-contacting surface 1306*c* and/or 1326*c* in a forward-directed motion and thus to be removed from the product display merchandiser 1300. Here, the at least one of the first and second product stops that is movable is a side product stop 1326 coupled to a front end of one of the sidewalls 1324 in the pair of sidewalls.

In one example, the at least one of the first and second product stops that is movable (here, side product stop 1326) is at least one of deformable and pivotable. For example, the at least one of the first and second product stops that is movable (here, side product stop 1326) comprises a flexible product stop flap 1326 that is detachably coupled to a relatively rigid product stop holder 1325, the product stop holder 1325 being connected to the front end of the one of the sidewalls 1324. The product stop holder 1325 has a cavity 1325*a* configured to receive a portion 1326*a* of the product stop flap 1326.

Features of the various embodiments described above can be interchanged with each other in any combination to create other embodiments which are contemplated herein. For instance, sidewalls 1124 of the product display merchandiser 1100, 1200, or 1300 may be transparent as in the product display merchandiser 1000. Additionally, the description of specific merchandisers or merchandiser components above enables a person of ordinary skill in the art to make and use those embodiments. Therefore various methods of making and using the above described embodiments are considered herein. Exemplary methods include methods of manufacturing the above described merchandisers as well as methods of displaying products utilizing the above described merchandisers.

For example, a method of displaying products according to the present disclosure comprises supporting a plurality of products on a sloped or horizontal product support and biasing the plurality of products forward along the product support with gravity and/or a spring-biased pusher. The method includes restricting forward movement of a bottom end of a front-most product with a lower product stop, the lower product stop extending upwardly with respect to the product support. The method includes further restricting forward movement of the front-most product with an upper product stop, the upper product stop extending inward toward the product support from at least one sidewall extending upward with respect to a side of the product support. The method includes moving the upper product stop out of engagement with the front-most product to allow the front-most product to be removed from the product support. According to the present disclosure, biasing the plurality of products and restricting forward movement of the bottom end of the front-most product causes the front-most product to tilt forward relative to the pusher.

In another example, a method according to the present disclosure includes providing a product display merchandiser according to any of the above-described embodiments and advancing product via a combination of a sloped/angled tray and a light spring-biased pusher such that the merchandiser can be used to front face delicate product.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein In the present description, certain terms have been used for brevity, clarity, and understanding. No unnecessary limitations are to be implied therefrom beyond the requirement of the prior art because such terms are used for descriptive purposes only and are intended to be broadly construed. The different components and assemblies described herein may be used or sold separately or in combination with other components and assemblies. Various equivalents, alternatives, and modifications are possible within the scope of the appended claims. Each limitation in the appended claims is intended to invoke interpretation under 35 USC § 112(f) only if the terms "means for" or "step for" are explicitly recited in the respective limitation.

What is claimed is:

1. A product display merchandiser comprising:

a product support;

a pair of sidewalls extending upwardly on respective longitudinally extending sides of the product support;

a first product stop extending upwardly from a front end of the product support and configured to contact a bottom end of a front-most product with which the product display merchandiser is to be stocked;

a second product stop coupled to at least one sidewall of the pair of sidewalls and having a product-contacting surface configured to contact at least one of a top end and a side edge on a front face of the front-most product; and a pusher longitudinally slidable relative to the product support and biased toward the front end of the product support;

wherein the second product stop comprises a flexible, elastomeric member that has a lower elastic modulus than the pair of sidewalls;

wherein the elastomeric member is a solid member that is longer vertically than it is wide and is elongated in a height direction of the at least one sidewall; and wherein the elastomeric member extends inward with respect to the at least one sidewall and is movable such that its product-contacting surface moves between a first orientation in which its product-contacting surface extends perpendicular to the at least one sidewall and is configured to contact the front face of the front-most product and a second orientation that allows the front-most product to be pulled past its product-contacting surface in a forward-directed motion and thus to be removed from the product display merchandiser.

2. The product display merchandiser of claim 1, further comprising a product stop holder at a front end of the at least one sidewall and having a higher elastic modulus than the elastomeric member, wherein the elastomeric member is detachably coupled to the product stop holder.

3. The product display merchandiser of claim 2, wherein the product stop holder has a cavity configured to receive a portion of the elastomeric member.

4. The product display merchandiser of claim 1, wherein each sidewall in the pair of sidewalls is textured to reduce friction between each sidewall and products with which the product display merchandiser is to be stocked.

5. The product display merchandiser of claim 1, wherein the sidewalls in the pair of sidewalls are angled outward relative to each other and to the product support.

6. The product display merchandiser of claim 1, wherein a front face of the pusher is angled non-perpendicular to the product support such that a bottom end of the pusher's front face is closer to the front end of the product support than a top end of the pusher's front face.

7. The product display merchandiser of claim 1, further comprising a third product stop, wherein the second product stop is coupled to a first sidewall of the pair of sidewalls, and the third product stop is coupled to a second sidewall of the pair of sidewalls.

8. The product display merchandiser of claim 1, further comprising a spring coupled to the product support and configured to bias the pusher toward the first and second product stops.

9. The product display merchandiser of claim 8, wherein the spring has a spring constant and the product support has a longitudinal length such that a maximum biasing force of the spring is less than or equal to 1 pound.

10. The product display merchandiser of claim 1, further comprising an engagement member coupled to the product support for hanging the product display merchandiser from a support structure, wherein the product support is sloped when the product display merchandiser is hung from the support structure such that a rear end of the product support is vertically higher than the front end of the product support.

11. The product display merchandiser of claim 1, wherein the second product stop comprises a flexible gate configured to contact the side edge and an opposing side edge of the front-most product.

12. The product display merchandiser of claim 1, wherein the second product stop extends vertically for at least 25% of a height of the front-most product.

13. The product display merchandiser of claim 1, wherein the second product stop extends vertically for at least 50% of a height of the front-most product.

14. The product display merchandiser of claim 1, wherein the elastomeric member has a solid, planar surface that acts as the product-contacting surface.

15. A product display merchandiser comprising:

a tray having a product-supporting top surface;

a pair of sidewalls extending upwardly with respect to the top surface of the tray and along respective opposite, longitudinally extending sides of the tray;

a pusher longitudinally slidable along the top surface of the tray and positioned between the sidewalls in the pair of sidewalls; and first and second product stops, each product stop being coupled to at least one of the tray and a sidewall of the pair of sidewalls, and each product stop having a product-contacting surface configured to contact a front face of a front-most product with which the product display merchandiser is to be stocked to inhibit removal of the front-most product from the product display merchandiser;

wherein at least one of the first and second product stops is movable such that its product-contacting surface moves between a first orientation in which its product-contacting surface is configured to contact the front face of the front-most product and a second orientation that allows the front-most product to be pulled past its product-contacting surface in a forward-directed motion and thus to be removed from the product display merchandiser;

wherein the at least one of the first and second product stops that is movable is a deformable, flexible product stop flap and is coupled to a product stop holder located at a front end of one of the sidewalls in the pair of sidewalls; and wherein the product stop flap comprises an elongated engagement portion configured to be received in an elongated cavity of the product stop holder, the engagement portion and the cavity being elongated generally orthogonal to the product-supporting top surface of the tray.

16. The product display merchandiser of claim 15, wherein the other one of the first and second product stops is not movable, and its product-contacting surface is oriented rearward toward the tray.

17. The product display merchandiser of claim 15, wherein the elongated engagement portion and the elongated cavity extend in a vertical direction orthogonal to the plane of the tray.

* * * * *